US007605323B2

(12) United States Patent
Ishii

(10) Patent No.: US 7,605,323 B2
(45) Date of Patent: Oct. 20, 2009

(54) ENSEMBLE SYSTEM, AUDIO PLAYBACK APPARATUS AND VOLUME CONTROLLER FOR THE ENSEMBLE SYSTEM

(75) Inventor: Jun Ishii, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 12/034,673

(22) Filed: Feb. 21, 2008

(65) Prior Publication Data

US 2008/0202322 A1 Aug. 28, 2008

(30) Foreign Application Priority Data

Feb. 27, 2007 (JP) ..... 2007-047912

(51) Int. Cl.
*G10H 1/46* (2006.01)

(52) U.S. Cl. ..... 84/633; 84/665; 84/711

(58) Field of Classification Search ..... 84/633, 84/665, 711
See application file for complete search history.

(56) References Cited

U.S. PATENT DOCUMENTS 5,792,972 A * 8/1998 Houston ..... 84/645
6,143,973 A * 11/2000 Kikuchi ..... 84/645
7,206,272 B2 4/2007 Ishii et al.
2006/0032362 A1* 2/2006 Reynolds et al. ..... 84/601
2006/0112815 A1* 6/2006 Sant ..... 84/645
2006/0225554 A1* 10/2006 Price, Jr. ..... 84/1
2006/0272483 A1* 12/2006 Honeywell ..... 84/609
2007/0074622 A1* 4/2007 Honeywell ..... 84/609
2008/0202322 A1* 8/2008 Ishii ..... 84/633

FOREIGN PATENT DOCUMENTS

JP 2001308942 11/2007

* cited by examiner

*Primary Examiner*—David S. Warren
(74) *Attorney, Agent, or Firm*—Harness, Dickey & Pierce, PLC

(57) ABSTRACT

An audio playback apparatus, an automatic player musical instrument and a voltage controller form an ensemble system for producing music tunes in ensemble between the audio playback apparatus and the automatic player musical instrument, and the voltage controller is responsive to a volume control dial so as simultaneously to vary the loudness of electric tones radiated from the audio playback apparatus and acoustic tones produced through the automatic player musical instrument; when a user rotates the voltage control dial, an audio signal and a quasi audio signal are amplified, the audio signal is supplied to the sound system for converting the audio signal to the electric tones, and the quasi audio signal is demodulated to MIDI music data codes for changing the velocity from the original value to a new value for producing the acoustic tones or electronic tones through automatic playing or composition of waveform data.

22 Claims, 10 Drawing Sheets

26D
27
27a
27b
27c
27k
ELECTRONIC TONE GENERATING SYSTEM
29
28
28d
28h
1D
13
AUDIO PLAYBACK APPRATUS
28b
PRELIMINARY DATA PROCESSOR
MOTION CONTROLLER
28f
27d
CD
VOLUME CONTROLLER
SERVO CONTROLLER
28j
2D
27f
27h
27e
28a
S5
S4
27j
S3
SOLENOID-OPERATED ACTUATORS
PEDAL SENSORS
28c
28a

ENSEMBLE SYSTEM, AUDIO PLAYBACK APPARATUS AND VOLUME CONTROLLER FOR THE ENSEMBLE SYSTEM

FIELD OF THE INVENTION

This invention relates to an ensemble system and, more particularly, to an ensemble system for reproducing a music tune on the basis of audio data codes and music data codes, an audio playback apparatus of the ensemble system and a volume controller for the ensemble system.

DESCRIPTION OF THE RELATED ART

There are various sorts of sound reproducers. A compact disc player is a typical example of the sound reproducer, and an automatic player musical instrument is another example of the sound reproducer. The digital data to be supplied to the compact disc player is different from the digital data to be supplied to the automatic player musical instrument so that the compact disc player and automatic player musical instrument are not compatible.

In detail, audio data codes, which express discrete values on the waveform of an analog audio signal, are converted to electric tones through the compact disc player. On the other hand, the automatic player musical instrument is responsive to music data codes, which express note-on key events, pitch of tones to be produced, loudness of tones, note-off key events, effects, time intervals between the key events, so as to produce acoustic tones. The audio data codes are defined in the red book, and the formats of music data codes are defined in the MIDI (Musical Instrument Digital Interface) protocols.

The automatic player musical instrument is a combination of an acoustic musical instrument such as, for example, an acoustic piano and an automatic playing system. The automatic playing system has the information processing capability, and includes key actuators and pedal actuators. The key actuators are associated with the black keys and white keys of the acoustic piano, and the pedal actuators are provided for the pedals. When a user gives an instruction to reenact a music tune to the automatic playing system, the automatic playing system starts the information processing on the music data codes so as to determine how to drive the keys and pedals by means of the key actuators and pedal actuators. The key actuators and pedal actuators are sequentially energized by the automatic playing system, and the black keys, white keys and pedals are moved by means of the key actuators and pedal actuators along the music tune without any fingering of a human player.

The compact disc player includes a digital-to-analog converter, amplifiers and loudspeakers. The audio data codes are supplied to the digital-to-analog converter so that the analog audio signal is restored. The analog audio signal is equalized and amplified by means of the amplifiers, and is varied in magnitude as instructed through the volume controller. The analog audio signal is supplied from the amplifiers to the loudspeakers, and is converted to electric tones through the loudspeakers.

Thus, the sound reproducing process of compact disc player is different from that of automatic player musical instrument, and, accordingly, the digital data to be processed through the compact disc player expresses a sort of physical quantity different from that expressed by the music data codes. For this reason, it is impossible to reproduce a music tune through the compact disc player on the basis of the music data codes and vice versa.

Nevertheless, attempts have been made on ensemble between the compact disc player and the automatic player musical instrument. A typical example of ensemble techniques is disclosed in Japan Patent Application laid-open No. 2001-308942, and Japan Patent No. 3584849 is assigned to the ensemble technique disclosed in the Japan Patent Application laid-open. A CD-DA (Compact Disc-Digital Audio) is used for the ensemble between the compact disc player and the automatic player musical instrument. The music data codes are modulated, and the modulated music signal is converted to quasi audio data codes. The quasi audio data codes are stored in the data blocks for the right channel, and the audio data codes are stored in the data blocks for the left channel. The audio data codes are supplied to the compact disc player. On the other hand, and the quasi audio data codes are restored to the music data codes, and the music data codes are supplied to the automatic player musical instrument.

A problem is encountered in the prior art ensemble system in that users can not vary the loudness of acoustic tones. While a music tune is being reproduced through the automatic player musical instrument in ensemble with the compact disc player, the user can vary the volume of electric tones through the volume controller of the compact disc player. However, the user can not vary the loudness of acoustic tones produced through the automatic player musical instrument.

SUMMARY OF THE INVENTION

It is therefore an important object of the present invention to provide an ensemble system, system components of which are simultaneously varied in loudness of tones through a single manipulation of a user.

It is another important object of the present invention to provide an audio playback apparatus, which forms a part of the ensemble system.

It is also an important object of the present invention to provide a volume controller, which makes it possible to vary the loudness of the tones reproduced through the system components of the ensemble system.

In accordance with one aspect of the present invention, there is provided an ensemble system for reproducing a first sort of tones and a second sort of tones from pieces of audio data and pieces of music data expressing at least pitch and loudness of tones to be produced, respectively comprising a sound signal generator producing an audio signal representative of the pieces of audio data and a music signal representative of the pieces of music data, a volume control manipulator manipulated by a user so as simultaneously to vary the loudness of the first sort of tones and the loudness of the second sort of tones, a volume control signal generator connected to the volume control manipulator and producing a volume control signal representative of a target value of loudness of both of the first sort of tones and the second fort of tones on the basis of the manipulation of the user, a first volume data changer connected to the sound signal generator and the volume control signal generator and responsive to the volume control signal so as to vary the pieces of audio data expressing the loudness of the first sort of tones, a second volume data changer connected to the sound signal generator and the volume control signal generator and responsive to the volume control signal so as to vary the pieces of music data expressing the loudness of the second fort of tones, and a signal-to-sound converter connected to the first volume data changer and the second volume data changer, converting the audio signal output from the first volume data changer to the first sort of tones at the target value of loudness and producing the second sort of tones on the basis of the music signal output from the second volume data changer at the target value of loudness.

In accordance with another aspect of the present invention, there is provided an audio playback apparatus for producing a volume-regulated audio signal and volume regulated music data codes comprising a sound signal generator producing an audio signal representative of pieces of audio data expressing a first sort of tones and a music signal representative of pieces of music data expressing at least pitch and loudness of a second sort of tones, a volume control manipulator manipulated by a user so as simultaneously to vary the loudness of the first sort of tones and the loudness of the second sort of tones, a volume control signal generator connected to the volume control manipulator and producing a volume control signal representative of a target value of loudness of both of the first sort of tones and the second fort of tones on the basis of the manipulation of the user, a first volume data changer connected to the sound signal generator and the volume control signal generator and responsive to the volume control signal so as to vary the pieces of audio data expressing the loudness of the first sort of tones, thereby producing the voltage-regulated audio signal, and a second volume data changer connected to the sound signal generator and the volume control signal generator and responsive to the volume control signal so as to vary the pieces of music data expressing the loudness of the second fort of tones, thereby producing the voltage-regulated music data codes.

In accordance with yet another aspect of the present invention, there is provided a volume controller for modifying music data codes expressing at least pitch and loudness of tones to be produced comprising an estimator supplied with a volume control signal simultaneously expressing the loudness of the tones and loudness of other tones to be produced from audio data codes and determining a target value of the loudness of the tones on the basis of the volume control signal, a code restorer supplied with a music signal, and restoring the music signal to the music data codes, and a volume data modifier connected to the estimator and the code restorer and modifying bit strings of the music data codes expressing the loudness to other bit strings expressing the target value of loudness so as to produce voltage-regulated music data codes.

BRIEF DESCRIPTION OF THE DRAWINGS

The features and advantages of the ensemble system, audio playback apparatus and volume controller will be more clearly understood from the following description taken in conjunction with the accompanying drawings, in which.

DESCRIPTION OF THE PREFERRED EMBODIMENTS

Figure 1:
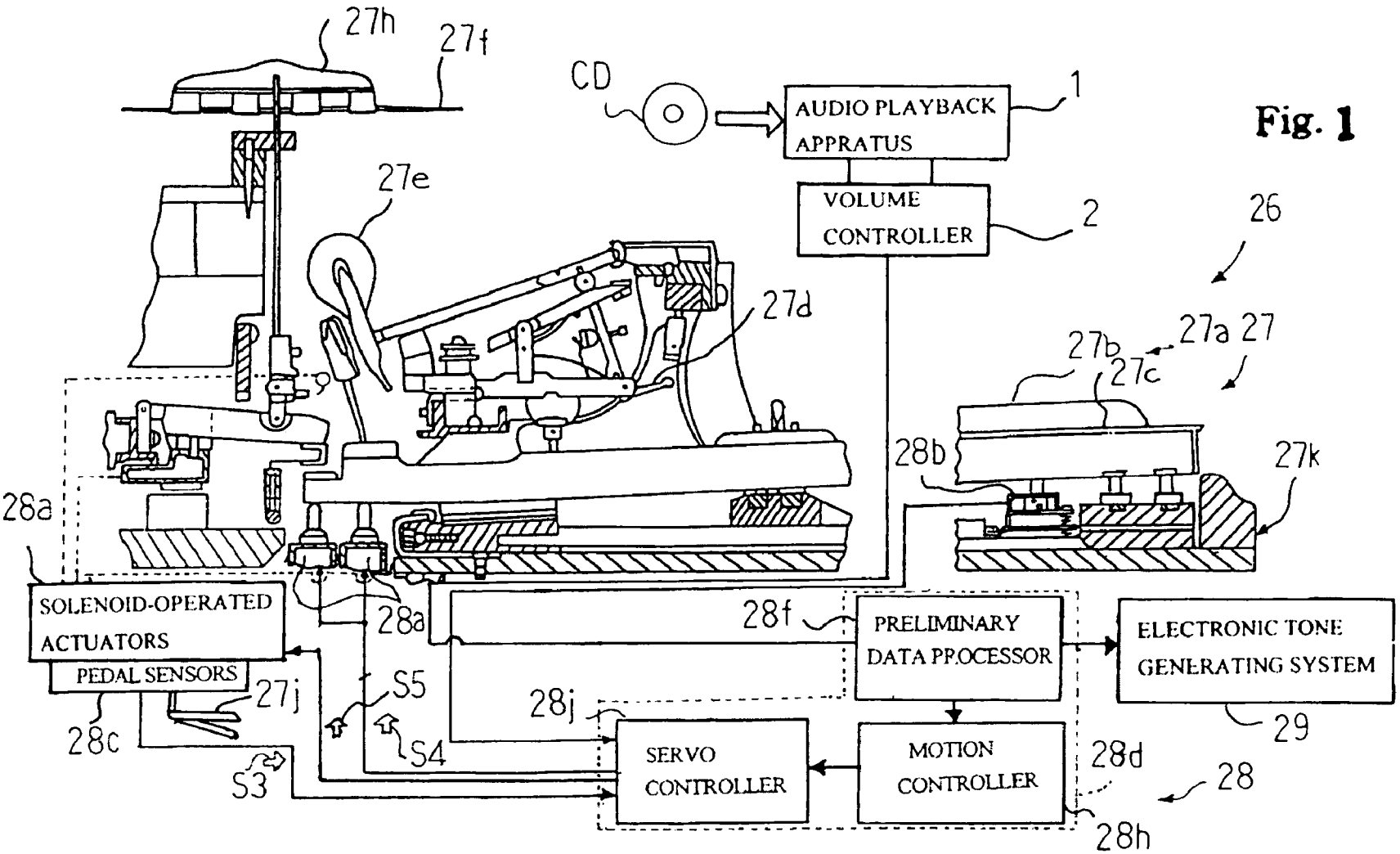
FIG. 1 is a schematic side view showing the structure of an automatic player musical instrument together with an audio playback apparatus and a volume controller of the present invention.

An ensemble system embodying the present invention is prepared for reproducing a first sort of tones and a second sort of tones from pieces of audio data and pieces of music data expressing at least pitch and loudness of tones to be produced, respectively. Although the pieces of music data expresses the pitch and loudness of second sort of tones to be produced, the pieces of audio data express another attribute of the first sort of tones. In this situation, a user can simultaneously change the loudness of first sort of tones and the loudness of second sort of tones by means of a volume control manipulator.

The ensemble system comprises a sound signal generator, the volume control manipulator, volume control signal generator, a first volume data changer, a second volume data changer and a signal-to-sound converter. The volume control manipulator is connected to the volume control signal generator. The sound signal generator and volume control signal generator are connected to the first volume data changer and further to the second volume data changer, and both of the first volume data changer and second volume data changer are connected to the signal-to-sound converter.

The sound signal generator produces an audio signal representative of the pieces of audio data and a music signal representative of the pieces of music data, and supplies the audio signal and music signal to both of the first volume data changer and second volume data changer. When the user wishes simultaneously to vary the loudness of first sort of tones and the loudness of second sort of tones, he or she manipulates the volume control manipulator by a certain displacement, and the volume control signal generator produces a volume control signal representative of a target value of loudness of both of the first sort of tones and second fort of tones on the basis of the manipulation of the user.

The volume control signal is supplied from the volume control signal generator to both of the first volume data changer and second volume data changer. The first volume data changer is responsive to the volume control signal so as to vary the pieces of audio data expressing the loudness of the first sort of tones, and the second volume data changer is also responsive to the volume control signal so as to vary the pieces of music data expressing the loudness of the second fort of tones. Thus, the pieces of audio data and pieces of music data are modified with a piece of volume control data represented by the volume control signal independently of one anther. Although the pieces of audio data and pieces of music data express different attributes of tones, the pieces of audio data expressing the loudness of first sort of tones and the pieces of music data expressing the loudness of second sort of tones are respectively varied through the data conversion in the first volume data changer and second volume data changer respectively adapted to vary the pieces of audio data and the pieces of music data codes.

After the data conversion, the audio signal and music signal are supplied from the first voltage data changer and second voltage data changer to the signal-to-sound converter, and are converted to the first sort of tones and the second sort of tones through the signal-to-sound converter.

The above-described system components of ensemble system are incorporated in a single or plural apparatus. All of the above-described system components may form a single apparatus such as, for example, an automatic player musical instrument or an electronic keyboard. Otherwise, the sound signal generator, volume control manipulator and first voltage data changer and a part of the signal-to-sound converter for the first sort of tones may form an audio playback apparatus, and the other part of the signal-to-sound converter for the second sort of tones may form another playback apparatus such as, for example, the automatic player musical instrument or electronic keyboard. The second voltage data changer may form a single apparatus physically independent of the audio playback apparatus and another playback apparatus, or form another part of the audio playback apparatus or another part of the other playback apparatus.

First Embodiment

Referring first to FIG. 1 of the drawing, an ensemble system embodying the present invention largely comprises an audio playback apparatus 1, a volume controller 2 and an automatic player musical instrument 26. Audio data codes are converted to electric tones by means of the audio playback apparatus 1, and acoustic tones are produced on the basis of music data codes by means of the automatic player musical instrument 26. The volume controller 2 is connected between the audio playback apparatus 1 and the automatic player musical instrument 26, and changes pieces of music data of the music data codes expressing the loudness of tones from original values to other values. The loudness of electric tones is varied by means of a volume control dial 13 (see FIG. 2) of the audio playback apparatus, and the loudness of acoustic tones is concurrently varied through rotation of the volume control dial 13.

In this instance, a set of music data codes is modulated to quasi-audio data codes, and the audio data codes and quasi-audio data codes are stored in a compact disc-digital audio CD. The quasi-audio data codes are stored in the data blocks for the right channel, and the audio data codes are stored in the data blocks for the left channel.

The automatic player musical instrument 26 includes an acoustic piano 27, an automatic playing system 28 and an electronic tone generating system 29. The automatic player musical instrument 26 reproduces acoustic piano tones or electronic tones on the basis of the music data codes expressing music tunes. The music data codes are broken down into several categories, and "a key event data code", which expresses a note-on key event, note number assigned to the key to be depressed, i.e., the pitch of tones and key velocity, i.e., loudness of tones or a note-off event and note number assigned to the key to be released, "an effect data code", which expresses an effect to be imparted to the tones, and "a duration data code", which expresses a time period between a key event and the next key event, belong to different categories.

The automatic playing system 28 performs a music tune on the acoustic piano 27 on the basis of the music data codes without any fingering of a human player. An audio signal is produced on the basis of the music data codes by means of the electronic tone generating system 29, and is converted to electronic tones. Thus, users have a choice between the automatic playing system and the electronic tone generating system 29.

The acoustic piano 27 includes a keyboard 27*a*, i.e., an array of black keys 27*b* and white keys 27*c*, action units 27*d*, hammers 27*e*, strings 27*f*, dampers 27*h*, a pedal mechanism 27*j* and a piano cabinet 27*k*. The keyboard 27*a* is mounted on a key bed, which forms a bottom part of the piano cabinet 27*k*, and the black keys 27*b* and white keys 27*c* are linked with the action units 27*d* at the intermediate portions thereof and dampers 27*h* at the rear portions thereof. The action units 27*d* are further linked with the hammers 27*e*, and the hammers 27*e* are opposed to the strings 27*f*. The dampers 27*h* are spaced from and brought into contact with the strings 27*f* depending upon the key positions on loci of keys 27*b*/27*c*. The pedal mechanism 27*j* is linked with the keyboard 27*a* and dampers 27*h*, and the human player and automatic playing system 28 directly change the keyboard 27*a* and dampers 20*h* for artificial expressions.

While all of the black and white keys 27*b*/27*c* are staying at rest positions, the hammers 27*e* are spaced from the strings 27*f*, and the dampers 27*h* are held in contact with the strings 27*f* as shown in FIG. 1.

When the human player depresses one of the black and white keys 27*b*/27*c*, the depressed key 27*b*/27*c* starts to travel on the locus. While the depressed key 27*b*/27*c* is traveling on the locus, the depressed key 27*b*/27*c* causes the dampers 27*h* to be spaced from the strings 27*f*, and actuates the associated action unit 27*d*. The actuated action unit 27*d* makes the hammer 27*e* driven for rotation toward the string 27*f*. The hammer 27*e* is brought into collision with the string 27*f* at the end of rotation, and gives rise to vibrations of the string 27*f*. The vibrating string 27*f* in turn gives rise to the vibrations of a sound board, which forms a part of the piano cabinet 27*k*, and an acoustic piano tone is radiated from the acoustic piano 27. The hammer 27*e* rebounds on the string 27*f*, and is captured by the action unit 27*d*.

The loudness of acoustic piano tone is proportional to the velocity of hammer 27*e* immediately before the collision with the string 27*f*. The human player and automatic playing system 28 strongly depress the black keys 27*b* and white keys 27*c* so as to produce the acoustic piano tones at large loudness. On the other hand, the human player and automatic playing system 28 gently depress the black keys 27*b* and white keys 27*c* for the acoustic piano tones at small loudness.

When the human player releases the depressed key 27*b*/27*c*, the released key 27*b*/27*c* starts backwardly to travel on the locus. The released key 27*b*/27*c* permits the damper 27*h* to move toward the string 27*f*, and is brought into contact with the vibrating string 27*f* so as to decay the vibrations. The released key 27*b*/27*c* further permits the action unit 27*d* to return to the rest position shown in FIG. 1.

When the human player and automatic playing system give the artificial expression to the acoustic piano tones, the human player and automatic playing system 28 depress the pedal of the pedal mechanism 27*j*, and makes the acoustic piano tone prolonged or lessened in loudness.

The automatic playing system 28 includes solenoid-operated actuators 28*a*, the key sensors 28*b*, pedal sensors 28*c* and an electronic system 28*d*. The solenoid-operated actuators 28*a* are provided for the black keys 27*b*, white keys 27*c* and pedal mechanism 27*j*, and are selectively energized by the electronic system 28*d* so as to give rise to the movements of the black keys 27*b*, white keys 27*c* and pedal mechanism 27*j*.

The volume controller 2 is connected to the electronic system 28*d*, and the electronic system 28*d* is connected to the electronic tone generating system 29. While the automatic player musical instrument 26 is reproducing a music tune, the music data codes are supplied from the volume controller 2 to the electronic system 28*d*, and the electronic system 26*d* selectively drives the solenoid-operated actuators 28*a* with driving signals S4 and S5 so as to depress and release the black keys 27*b*, white key 27*c* and pedal mechanism 27*j* on the basis of the music data codes stored in the received MIDI file. When the user selects the electronic tones, the music data codes are transferred from the electronic system 28*d* to the electronic tone generating system 29, and the audio signal, which is produced on the basis of the music data codes, is converted to the electronic tones.

The electronic system 28*d* includes an information processor and current driving circuits (not shown) such as, for example, pulse width modulators. A computer program for an automatic playing runs on the information processor so as to realize functions referred to as a "preliminary data processor 28f", a "motion controller 28h" and a "servo controller 28j". Since the key event data codes and effect data codes are produced on the assumption that they are applied to an ideal MIDI musical instrument, the pieces of event data and pieces of effect data are to be individualized to the automatic player musical instrument 26. The preliminary data processor 28*f* makes the music data codes in the received MIDI file individualized to the automatic player musical instrument 26.

While the computer program is running on the information processor, preliminary data processor 28*f* measures the lapse of time from the previous key event and previous pedal event on the basis of the duration data codes, and supplies the new key event data code or new pedal event data code to the motion controller 28*h* upon expiry of the time period.

The time to process a note-on event data code is assumed to come. The motion controller 28*h* analyzes the piece of event data, and determines a reference forward key trajectory. The reference forward key trajectory is a series of values of target key position varied together with time. If the black key 27*b* or white key 27*c* travels on the reference forward key trajectory, the hammer 27*e* is brought into collision with the string 27*f* at a target time at which the acoustic piano tone is to be produced, and the acoustic piano tone is generated through the vibrations of string 27*f* at a target value of loudness. Therefore, the key velocity in the key event data code is reflected to the reference forward key trajectory. Values of target key position are periodically supplied from the motion controller 28*h* to the servo controller 28*j*.

The key sensors 28*b* supply key position signals SI indicative of the actual key position of the associated black keys 27*b* and white keys 27*c* to the servo controller 28*j*. The servo controller 28*j* calculates a value of target key velocity from a series of values of target key velocity and a value of actual key velocity from a series of values of actual key position, and compares the value of target key position and value of target key velocity with a value of actual key position and a value of actual key velocity so as to determine the difference between the target key position and the actual key position and the difference between the target key velocity and the actual key velocity. The servo controller 28*j* increases or decreases a target value of mean current of the driving signal S4 in such a manner as to minimize the different of key position and difference of key velocity, and the current driving circuit (not shown) adjusts the driving signal S4 to the target value of means current. The above-described jobs are periodically repeated for the black/white key 27*b*/27*c*. Thus, the solenoid-operated actuators 28*a* for the black and white keys 27*b*/27*c*, key sensors 28*b*, servo controller 28*j* and current driving circuits (not shown) form a servo control loop, and the black keys 27*b* and white keys 27*c* are forced to travel on the reference forward key trajectories through the servo control loop.

The time to process a note-off event data code is assumed to come. The motion controller 28*h* determines a reference backward key trajectory on the basis of the piece of note-off event data. The reference backward key trajectory is a series of values of target key position toward the rest position. If the black key 27*b* or white key 27*c* travels on the reference backward key trajectory, the released key 27*b*/27*c* permits the damper 27*h* to be brought into contact with the vibrating string 27*f* at the time to make the note-off event occur, and the acoustic piano tone is decayed. The values of target key position are periodically supplied from the motion controller 28*h* to the servo controller 28*j*, and the servo controller 28*j* forces the released key 27*b*/27*c* to travel on the reference backward key trajectory through the servo control loop.

The time to process an effect data code is assumed to come. The motion controller 28*h* determines a reference pedal trajectory on the basis of the piece of effect data. The reference pedal trajectory is a series of values of target pedal position, and the values of target pedal position are periodically supplied from the motion controller 28*h* to the servo controller 28*j*. The pedal sensors 28*c* monitor the pedals of the pedal mechanism 27*j*, and supply a pedal position signal S3 indicative of an actual pedal position to the servo controller 28*j*. The servo controller 28*j* calculates a target pedal velocity and an actual pedal velocity, and determines the mean current of the driving signal S5 in such a manner as to minimize the difference between the target pedal position and the actual pedal position and the difference between the target pedal velocity and the actual pedal velocity. The current driving circuit (not shown) adjusts the driving signal S5 to the value of mean current, and the driving signal S5 is supplied from the current driving circuit (not shown) to the solenoid-operated actuator 28*a* provided for the pedal. The above-described jobs are periodically repeated, and the pedal is forced to travel on the reference pedal trajectory.

While the music tune is being reproduced on the basis of the music data codes of the received MIDI file, the above-described control sequences are repeated for all of the black and white keys 27*b*/27*c* to be depressed and released and all the pedals to be depressed and released. This results in the playback of the music tune.

Figure 2:
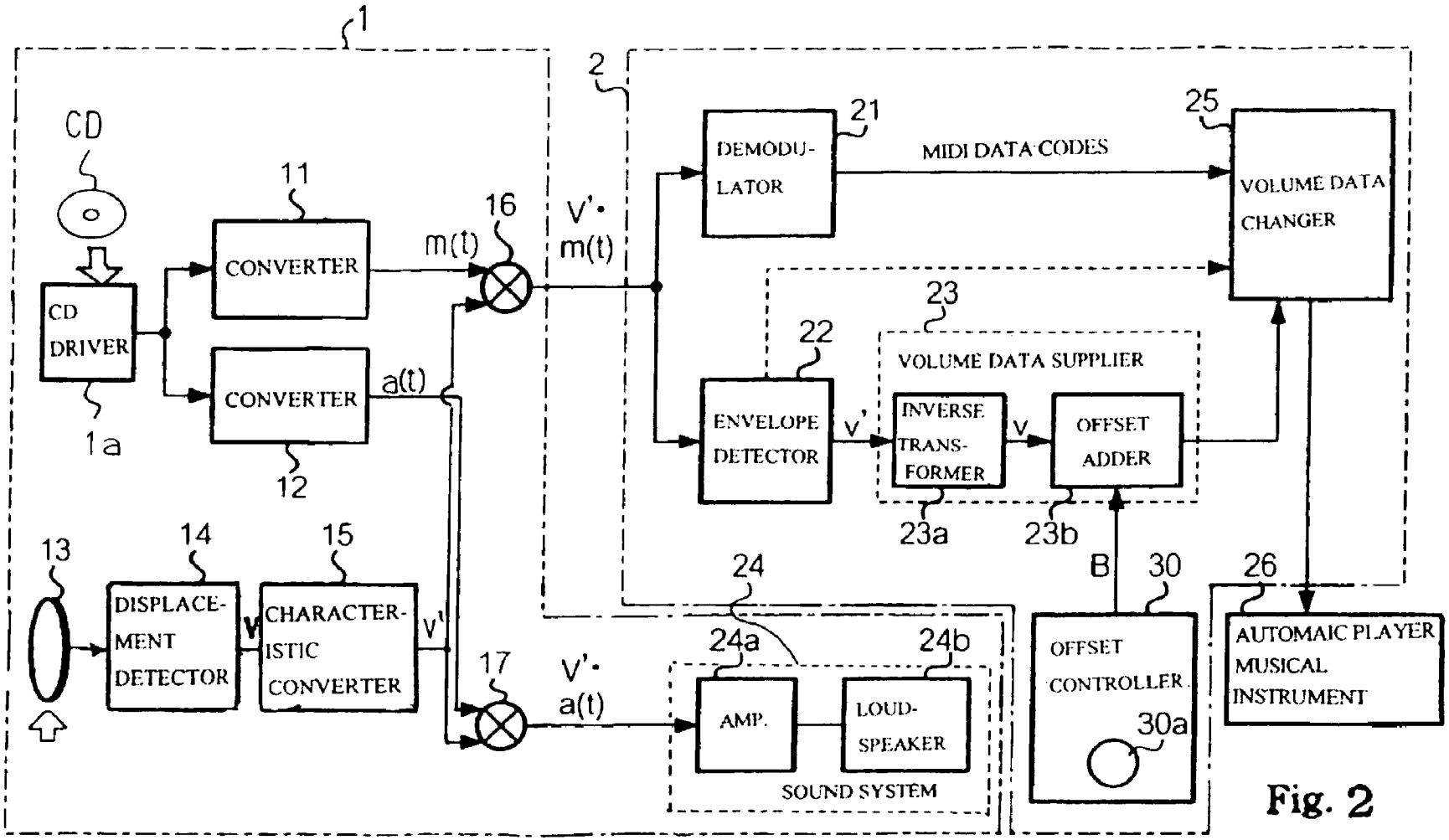
FIG. 2 is a block diagram showing the system configuration of audio playback apparatus and the system configuration of volume controller.

FIG. 2 shows the system configuration of audio playback apparatus 1 and the system configuration of audio playback apparatus 1 and the system configuration of volume controller 2.

The audio playback apparatus 1 includes a compact disc driver 1*a*, a converter 11 for the right channel, a converter 12 for the left channel, the volume control dial 13, a displacement detector 14, a characteristic converter 14, multiplier 16 and 17 and a sound system 24. The compact disc driver 1*a* is connected to the converters 11 and 12, and the converters 11 and 12 are respectively connected to the multipliers 16 and 17. The sound system 24 includes amplifiers 24*a* and loudspeakers 24*b*.

As described hereinbefore, the quasi-audio data codes, which are modulated on the basis of the music data codes, are stored in the data blocks for the right channel, and the audio data codes are stored in the data blocks for the left channel. The quasi audio data codes are supplied from the compact disc driver 1*a* to the converter 11, and an analog quasi audio signal m(t) is produced from the quasi analog audio data codes. On the other hand, the audio data codes are supplied from the compact disc driver 1*a* to the converter 12, and an analog audio signal a(t) is produced from the audio data codes. The amplitude of analog quasi audio signal is not widely varied, i.e., almost constant, because the analog quasi audio signal was modulated on the basis of the music data codes expressing various sorts of MIDI messages.

The volume control dial 13 is connected to the displacement detector 14, and a user rotates the volume control dial 13 so as to instruct the audio playback apparatus 1 to vary the loudness of electric tones. The rotational angle is converted to a detecting signal v representative of the rotational angles, i.e., displacement of the volume control dial 13.

The displacement detector 13 is connected to the characteristic converter 15 so that the detecting signal v is supplied from the displacement detector 14 to the characteristic converter 15. Human beings recognize the variation of the loudness of tones as a logarithmic function. In other words, while human beings are rotating a volume control dial on the condition that the tones are continuously produced through an audio playback apparatus, the human beings feel the increment of loudness of tones per unit angle gradually decreased. For this reason, even if the tones are adjusted to his or her favorite loudness, the tones are too loud to be comfortably heard by the human beings. It is desirable to convert the rotational angle in such a manner as to cancel the tendency, which is expressed as logarithmic function. For this reason, the characteristic converter 15 carries out exponential transformation on the detecting signal v as $$v'=A\times e^{v} \qquad \text{Equation 1}$$

where A is a constant determined on the basis of the potential level and circuit characteristics. Thus, the detecting signal v is converted to a volume control signal v'.

The volume control signal v' is supplied from the characteristic converter 15 to the multipliers 16 and 17. The value of analog quasi audio signal m(t) and value of analog audio signal a(t) are multiplied by the value of volume control signal v' by means of the multipliers 16 and 17, and a regulated quasi audio signal (v'·m(t)) and a regulated audio signal (v'·a(t)) are respectively supplied from the multipliers 16 and 17 to the volume controller 2 and sound system 24. The regulated audio signal (v'·a(t)) is equalized and amplified through the amplifiers 24*a*, and, thereafter, is converted to the electric tones through the loudspeakers 24*b*.

The volume controller 2 includes a demodulator 21, an envelope detector 22, a volume data supplier 23, a volume data changer 25 and an offset controller 30. The volume data supplier 23 has an inverse transfer 23*a* and offset adder 23*b*. The multiplier 16 is connected to the demodulator 21 and envelope detector 22, and the demodulator 21 and envelope detector 22 are connected in parallel to the volume data changer 25 and the volume data supplier 23, respectively. In the volume data supplier 23, the inverse transformer 23*a* is connected to the offset adder 23*b*, and the envelope detector 22 is connected to the inverse transformer 23*a*. The offset controller 30 and inverse transformer 23*a* are connected to input nodes of the offset adder 23*b*, and an output node of the offset adder 23*b* is connected to the volume data changer 25. The output node of volume data changer 25 is connected to the automatic player musical instrument 26.

The volume controller 2 achieves the following functions. The regulated quasi audio signal (v'·m(t)) is restored to the music data codes or MIDI data codes through the demodulator 21. The demodulating technique disclosed in Japan Patent Application laid-open 2001-308942 is, by way of example, employed in the demodulator 21. On the other hand, an envelope of the regulated quasi audio signal (v'·m(t)) is determined by means of the envelope detector 22, and the envelope detector 22 informs the volume data supplier 23 of the value v'. Since the analog quasi audio signal m(t) is produced from the quasi audio data codes, which is produced on the basis of the bit strings of music data codes, the amplitude of analog quasi audio signal is almost constant, and the amplitude is v' times increased through the multiplication through the multiplier 16. In other words, the ratio between the envelope of regulated quasi audio signal (v'·m(t)) and the amplitude of analog quasi audio signal m(t) is equal to the value v'. It is possible to determine the value v' on the basis of the envelope of regulated quasi audio signal (v'·m(t)).

The volume data supplier 23 determines a volume regulating signal on the basis of the amount of displacement and an offset value, and the volume regulating signal is supplied from the volume data supplier 23 to the volume data changer 25.

In detail, the inverse transformer 23*a* carries out an inverse transformation to the exponential transformation on the value of volume control signal v' determined from the envelope. The inverse transformation is expressed as $$v=\ln(v'/A) \qquad \text{Equation 2}$$

where In is naturalized logarithm. Thus, the restored value of detecting signal v is obtained through the inverse transformation. An offset value B and the restored value of detecting signal v are supplied from the offset controller 30 and the inverse transformer 23*a* to the offset adder 23*b*, and the offset value B is added to the restored value of detecting signal v by means of the offset adder 23*b*. Thus, the value of volume regulation signal is given as the sum of the restored value and offset value B.

The user gives the offset value B to the offset adder 23*b* through rotation of an offset control dial 30*a*. Although the rotation of volume control dial 13 is converted to the detecting signal v by means of the displacement detector 14, the characteristics of circuit components such as, for example, a variable register and transistors are not constant among the products. Moreover, the recording conditions are not equalized between the audio data codes and the quasi audio data codes. These dispersion and differences result in imperfect balance between the analog audio signal a(t) and the analog quasi audio signal m(t). In order to cancel those dispersion differences, the user manually gives the offset value B through the offset controller 30 to the offset adder 23*b*. The user rotates the offset control dial 30*a* as he or she is listening to the electric tones and the electronic tones/acoustic piano tones. As will be described in conjunction with the volume data changer 25, the data byte expressing the velocity is varied on the basis of the sum of restored value v and offset value B so that the electric tones are well balanced with the electronic tones or acoustic piano tones.

The volume data changer 25 includes an information processing system, and, accordingly, has an information processing capability. The information processing system includes a central processing unit, peripheral processors, a working memory, which is implemented by a random access memory, a program memory and a signal interface. The pieces of music data, which express the velocity, i.e., the loudness of tones, are changed through the data processing, and the volume-regulated music data codes are supplied from the volume data changer 25 to the automatic player musical instrument 26.

Figure 3:
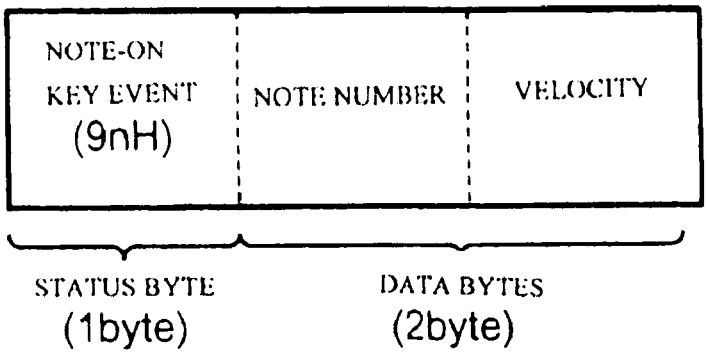
FIG. 3 is a view showing the structure of a music data code expressing a note-on key event.

FIG. 3 shows the music data code expressing the note-on key event. The music data code is broken down into a status byte and data bytes. The status byte expresses the note-on key event. "9nH" is assigned to the note on key event in the MIDI protocols, and "n" is the channel number. As described hereinbefore, users choose either automatic playing system 28 or electronic tone generating system 29. The automatic playing system 28 and electronic tone generating system 29 have different channel numbers n, and the electronic system 28*d* steers the music data codes to the automatic playing system 28 or electronic tone generating system 29 depending upon the channel number n. The data bytes express the note number and velocity, respectively. The pitch of tone to be produced is correlated with the note number, and the note number is varied from zero to 127 in the MIDI protocols. The velocity means the loudness of tone to be produced, and is varied from 1 to 127 in the MIDI protocols.

When a music data code arrives at the signal interface, the central processing unit checks the music data code to see whether or not the status byte expresses the note-on key event. If the status byte is "9nH", the answer is given affirmative, and the music data code is temporarily stored in the working memory. The central processing unit changes the velocity from the original hexadecimal number to a new hexadecimal number in response to the volume regulation signal. Thus, the volume data changer 25 increases, decreases or maintains the velocity, and produces the volume-regulated music data codes.

The volume-regulated music data codes are supplied from the volume data changer 25 to the automatic player musical instrument 26, and the automatic playing system reenacts the music tune on the acoustic piano 27 on the basis of the volume-regulated music data codes and other music data codes, which are also transferred from the volume data changer 25 to the automatic player musical instrument 26.

Figure 4:
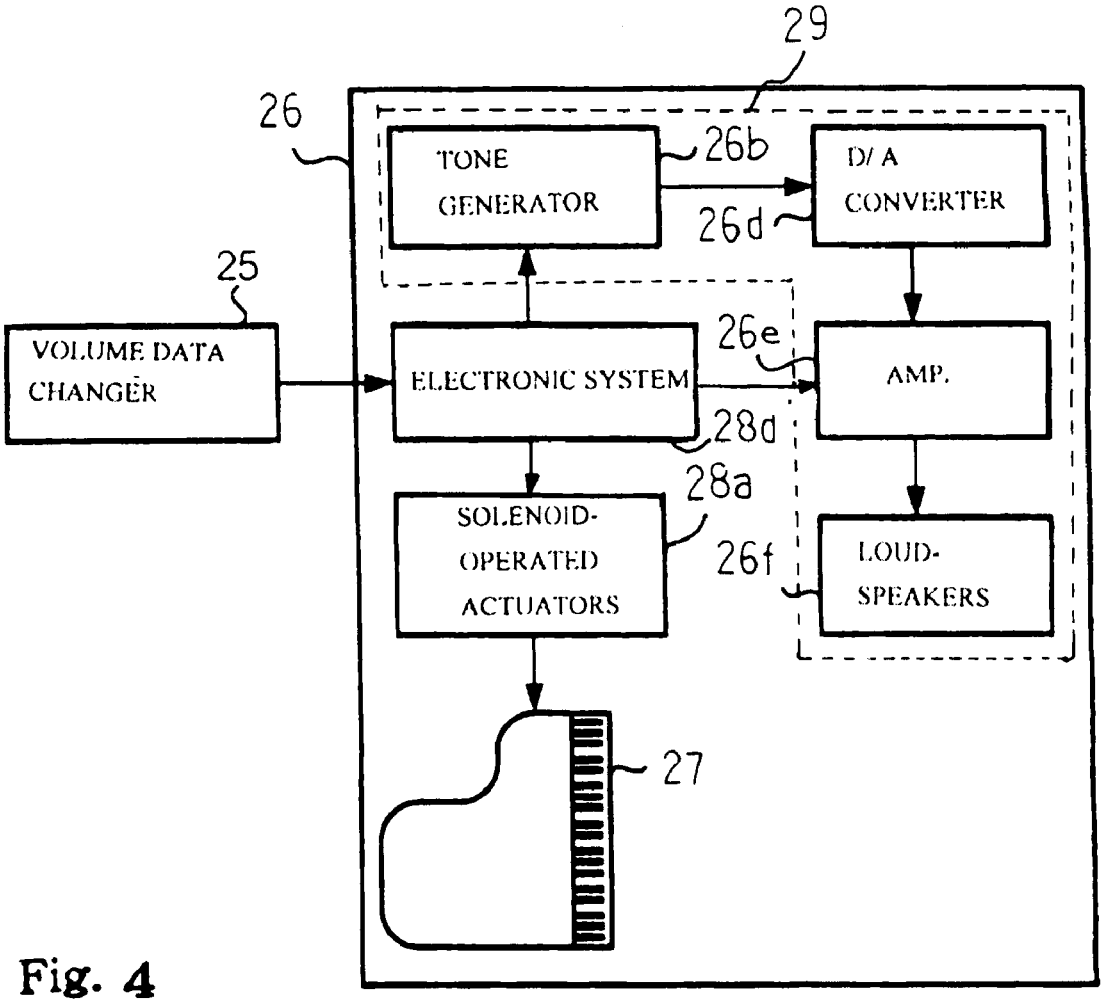
FIG. 4 is a block diagram showing the system configuration of the automatic player musical instrument.

FIG. 4 shows the system configuration of the automatic player musical instrument 26. Since the acoustic piano 27 and automatic playing system 28 are hereinbefore described with reference to FIG. 1, description is focused on the electronic tone generating system 29.

The electronic tone generating system 29 includes a tone generator 26*b*, amplifiers 26*e* and loudspeakers 26*f*. Waveform memories and data readers are incorporated in the tone generator 26*b*. Plural sets of pieces of waveform data are stored in the waveform memories, and express the waveforms of tones to be produced. The pieces of waveform data are successively read out through each of the data readers for producing an electronic tone, and the pieces of reach-out waveform data are restored to the waveform of an analog audio signal through the digital-to-analog converter. The amplifiers 26*e* make the analog audio signal equalized and amplified, and the analog audio signal is converted to the electronic tones by means of the loudspeakers.

A master volume message and a piece of velocity data of note-on key event data express the loudness of tones to be produced. In case where the electronic tones are produced, the volume change is carried out through the amplifiers 26*e*.

The status byte is assumed to have the channel number indicative of the electronic tone generating system 29. The volume-regulated music data codes and the other music data codes are supplied from the volume data changer 25 to the electronic system 28*d*, and are steered to the electronic tone generating system 29 by means of the electronic system 28*d*. When the volume-regulated music data code arrives at the tone generator, a set of pieces of waveform data is selected from the waveform memories, and gets ready to be read out through one of the data readers. While the pieces of waveform data are being read out from the waveform memories, the pieces of waveform data are supplied from the data reader to the digital-to-analog converter 26*d*, and are synthesized to the waveform of the tone to be produced in the digital-to-analog converter. Thus, the pieces of waveform data are restored to the waveform of analog audio signal.

The analog audio signal is supplied from the digital-to-analog converter 26*d* to the amplifiers 26*e*, and is equalized and amplified by means of the amplifiers 26*e*. The analog audio signal is supplied from the amplifiers 26*e* to the loudspeakers 26*f*, and is converted to the electronic tones.

The above-described data processing and signal conversion are repeated for all the electronic tones to be produced.

When the music data codes expressing the note-off key events arrive at the tone generator 26*b*, the tone generator 26*b* starts to decay the magnitude of pieces of waveform data so as to minimize the amplitude of analog audio signal. Thus, the tone is decayed.

The ensemble system behaves as follows. A user is assumed to put a CD-DA on a disc tray of the compact disc driver 1*a*. The quasi-audio data codes are stored in the data blocks for the right channel, and the audio data codes are stored in the data blocks for the left channel. The user instructs the audio playback apparatus 1 to reproduce a piece of music expressed by the quasi-audio data codes and audio data codes in ensemble with the automatic player musical instrument 26 through a push button on an manipulating panel of the audio playback apparatus. Then, the compact disc driver 1*a* starts to read out the pieces of quasi audio data codes and audio data codes are read out from the CD-DA. The quasi audio data codes are supplied from the compact disc driver 1*a* to the converter 11, and are converted to the analog quasi audio signal m(t) through the converter 11. On the other hand, the audio data codes are supplied from the compact disc driver 1*a* to the other converter 12, and are converted to the analog audio signal a(t) through the converter 12.

The user rotates the volume control dial 13 so as to adjust the loudness of tones to his or her favorite value. The rotating angle is indicative of the favorite value v of the loudness. The rotating angle is detected by means of the displacement detector 14, and the detecting signal indicative of the loudness v is supplied from the displacement detector 14 to the characteristic converter 15. The characteristic converter 15 determines the value v' through the exponential transformation, and supplied the volume control signal v' to the multipliers 16 and 17.

The value on the waveform of analog quasi audio signal m(t) is multiplied by the value v' of volume control signal, and the value on the waveform of analog audio signal a(t) is also multiplied by the value v' of volume control signal. The regulated quasi audio signal (v'·m(t)) is supplied from the multiplier 16 to both of the demodulator 12 and envelope detector 22, and the regulated audio signal (v'·a(t)) is supplied from the multiplier 17 to the sound system 24.

The regulated audio signal (v'·a(t)) is equalized and amplified through the amplifiers 24*a*, and, thereafter, is converted to the electric tones. Since t h e regulated audio signal (v'·a(t)) is (v') times greater than the analog audio signal a(t), the loudness of electric tones is consistent with the auditory sense of the user.

On the other hand, the regulated quasi audio signal is (v'·m(t)) demodulated to the music data codes through the demodulator 21, and the envelope of regulated quasi audio signal (v'·m(t)) is determined by means of the envelope detector 22. An envelope is give to the regulated quasi audio signal (v'·m(t)), and the value v' is determined as the ratio between the envelope of regulated quasi audio signal and the amplitude of analog quasi audio signal m(t). The detected signal indicative of the value v' is supplied from the envelope detector 22 to the inverse transformer 23*a*. The logarithmic transformation, i.e., the inverse transformation of exponential transformation is carried out on the value v' through the inverse transformer 23*a* so that the value v of displacement is calculated from the value v'. The offset value B is added to the value v by means of the offset adder 23*b*, and the volume regulated signal indicative of (v'+B) is supplied from the offset adder 23*b* to the volume changer 25. In the following description, the offset value B is assumed to be zero for the sake of simplicity.

The music data codes are intermittently supplied from the demodulator 21 to the volume changer 25. The volume changer 25 checks the music data codes to see whether or not the status byte expresses the note-on key event (9nH). When the answer is given negative, the music data codes are supplied from the volume changer 25 to the electronic system 28*d*. On the other hand, when the music data code has the status byte (9nH), the volume changer 25 extracts the data byte expressing the velocity from the music data code, and calculates a regulated value of velocity on the basis of the original value of velocity and the value v. The volume changer rewrites the data byte from the original value to the regulated value, and supplies the regulated music data code to the electronic system 28*d*.

A regulated music data code is assumed to arrive at the electronic system 28*d* on the condition that the user chose the electronic tones. The electronic system 28*d* determines the gain of amplifier 26*e* on the basis of the regulated value of velocity, and a control signal representative of the gain is supplied from the electronic system 28*d* to the amplifier 26*e*. The regulated music data code is supplied to the tone generator 26, and the pieces of waveform data are supplied from the tone generator 26*b* to the digital-to-analog converter 26*d*. The analog audio signal is produced from the pieces of waveform data, and is supplied to the amplifiers 26*e*. After the equalization, the analog audio signal is amplified at the gain so as to produce the electronic tones at the favorite value of loudness through the loudspeakers 26*f*. As a result, the electronic tones are varied in loudness together with the electric tones through the volume control dial 13.

When the user chose the acoustic piano tones, the regulated music data code is supplied to the motion controller 28*h*. The motion controller 28*h* determines the reference forward key trajectory on the basis of the regulated music data code and music data code expressing the time period from the previous key event. If the user increases the loudness of tones through the rotation of volume control dial 13, the gradient of reference forward key trajectory is enlarged. On the other hand, if the user decreases the loudness of tones, the gradient of reference forward key trajectory is reduced. The servo controller 28*j* forces the black key 27*b* or white key 27*c* to travel on the reference forward key trajectory. As described hereinbefore in conjunction with the servo controller 28*j* shown in FIG. 1, the reference forward key trajectory is a series of values of target key position in terms of time. For this reason, the black key 27*b* or white key 27*c* is moved at higher speed on the reference forward key trajectory with enlarged gradient, and is slowly moved on the reference forward key trajectory with reduced gradient. The larger the key speed is, the larger the hammer speed is; the larger the hammer speed is, the larger the loudness of acoustic piano tone is. Thus, the loudness of acoustic piano tones is varied in proportion to the value of velocity v defined in the music data code. As a result, the acoustic piano tones are varied in loudness together with the electric tones through the volume control dial 13.

As will be appreciated from the foregoing description, the user can simultaneously vary the loudness of electric tones together with the loudness of electronic tones/acoustic piano tones in spite of the difference in volume control principle between the audio playback apparatus 1 and the automatic player musical instrument 26 through the volume control dial 13.

Second Embodiment

Figure 5:
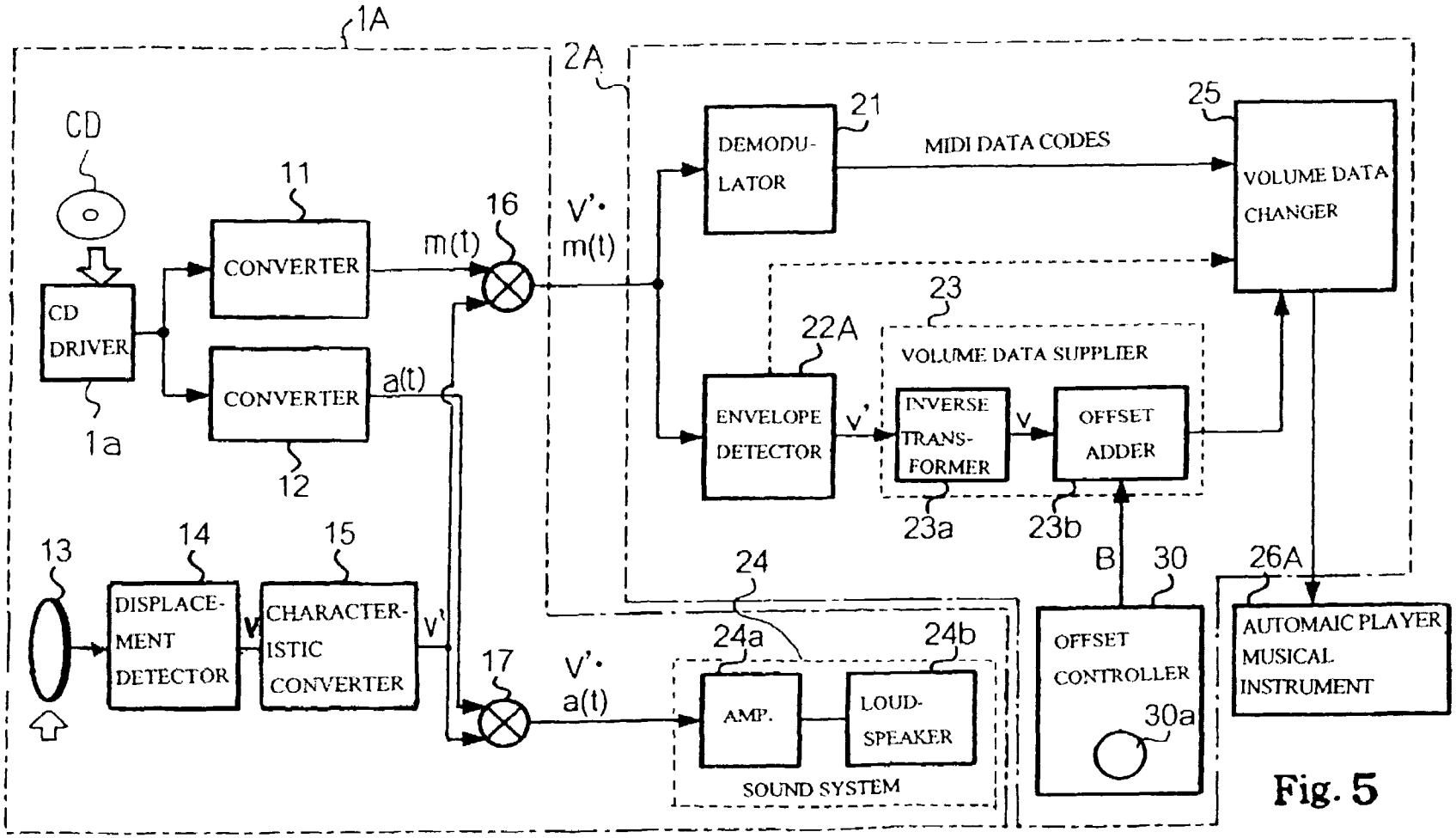
FIG. 5 is a block diagram showing the system configuration of audio playback apparatus and the system configuration of volume controller of another ensemble system of the present invention.

Turning to FIG. 5 of the drawings, another ensemble system embodying the present invention largely comprises an audio playback apparatus 1A, a volume controller 2A and an automatic player musical instrument 26A. The audio playback apparatus 1A and automatic player musical instrument 26A are similar to the audio playback apparatus 1 and automatic player musical instrument 26, respectively, and, for this reason, the system components of audio playback apparatus 1A are labeled with references same as those designating the system components of audio playback apparatus 1 without detailed description for the sake of simplicity.

Figure 6:
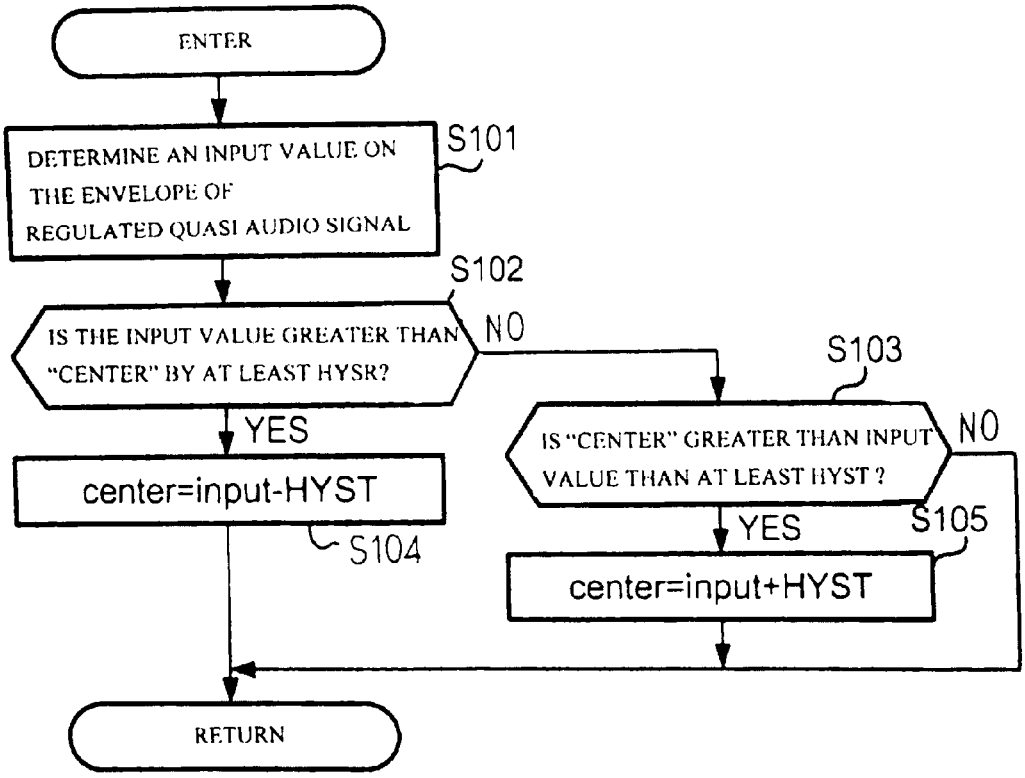
FIG. 6 is a flowchart showing a sequence of jobs executed by an envelope detector of a playback controller incorporated in the ensemble system.

The volume controller 2A is similar in circuit configuration to the volume controller 2 except for an envelope detector 22A. The other circuit components are labeled with references designating corresponding circuit components of the volume controller 2, and description is focused on the envelope detector 22A. In this instance, the envelope detector 22A has an information processing capability, and an information processor is incorporated in the envelope detector 22A together with a program memory and a working memory. A computer program shown runs on the information processor, and has a subroutine program shown in FIG. 6. The ripples of the envelope are absorbed through the execution of the subroutine program as will be hereinlater described.

Figure 7:
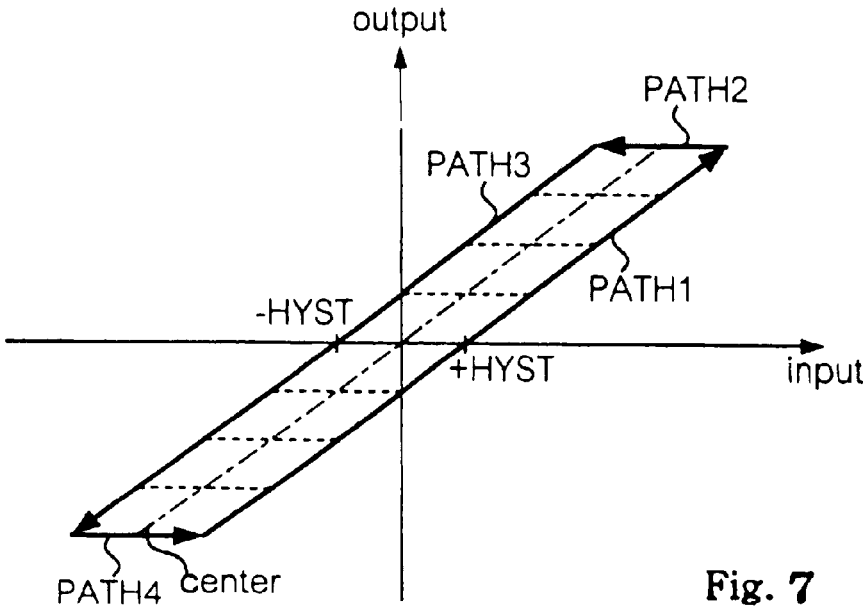
FIG. 7 is a graph showing hysteresis of input-and-output characteristics of the envelope detector.

In the first embodiment, the peak values of regulated quasi audio signal are almost constant. However, the modulating technique has non-ignorable influence on the stability of envelope. In case where an employed modulation technique makes the envelope of regulated quasi audio signal less stable, hysteresis is given to input-and-output characteristics of the envelope detector 22A as shown in FIG. 7. A constant HYST is indicative of half of the width of the hysteresis loop, and is stored in the program memory together with the computer program. The constant HYST is to be varied depending upon the modulation technique. Static variable "center" is set to zero during the system initialization. The information processor periodically enters the subroutine program, and carries out the following jobs.

The information processor fetches an input value on the envelope of the waveform of the regulated quasi audio signal (v'+B) so that the input value on the envelope is determined as by step S101.

Subsequently, the information processor compares the input value with the static variable "center" to see whether or not the input value is greater than the static variable "center" by at least the constant HYST as by step S102. When the input value is widely swung, the answer at step S102 is given affirmative "YES". Then, the static variable "center" is changed to "center=input−HYST" as by step S104. The information processor outputs the static variable "center" as the regulated value on the envelope.

On the other hand, when the answer at step S102 is given negative "NO", the information processor compares the difference between the static variable "center" and the input value to see whether or not the static variable "center" is greater than the input value by at least the constant "HYST"? as by step S103. When the answer at step S103 is given affirmative "YES", the information processor determines the result as the regulated value on the envelope. However, when the answer at step S103 is given negative "NO", the information processor outputs the static variable "center" as the regulated value on the envelope.

While the input value is being increased, the input value is correlated with the output value as indicated by arrow PATH1. When the input value is changed from ascent to descent, the correlation is moved as indicated by arrow PATH2. While the input value is being decreased, the correlation is moved as indicated by arrow PTH3. When the input value is changed from descent to the ascent, the correlation is moved as indicated by arrow PTH4. Thus, the hysteresis loop enhances the stability of envelope.

The other behavior of volume controller 2A is similar to that of the volume controller 2 so that no further description is hereinafter incorporated for the sake of simplicity.

As will be appreciated from the foregoing description, the user can simultaneously vary the loudness of electric tones and the loudness of acoustic piano tones/electronic tones by means of the single volume control dial 13 as similar to the first embodiment. Moreover, the input-to-output characteristics of the envelope detector 22A have the hysteresis so that the envelope detector 22A exactly determines the value v' of the volume control signal in spite of the poor stability of the envelope of the regulated quasi audio signal (v·m(t)).

Modification of Second Embodiment

Although the hysteresis loop shown in FIG. 7 is appropriate to the regulated quasi audio signal modulated through a certain modulation technique, the hysteresis loop is inappropriate to the regulated quasi audio signal modulated through another modulation technique.

Figure 8:
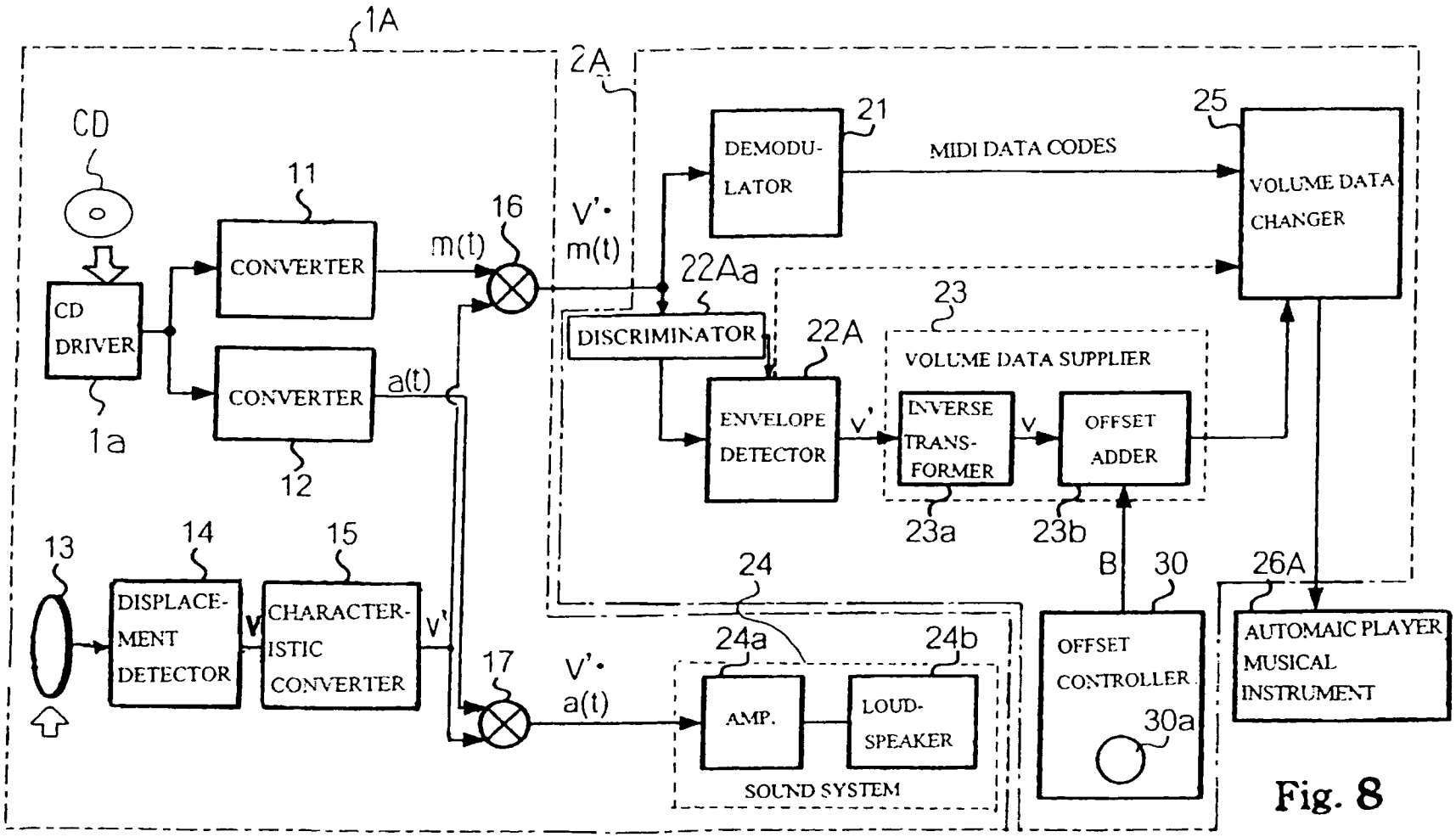
FIG. 8 is a block diagram showing the system configuration of audio playback apparatus and the system configuration of volume controller of a modification of the ensemble system shown in FIG. 5.

As described hereinbefore, the constant HYST is to be varied in dependent on the modulation technique. In order to cope with the quasi audio signal m(t) produced from quasi audio data codes modulated through different sorts of modulation techniques, a discriminator 22Aa is connected between the multiplier 16 and the envelope detector 22A as shown in FIG. 8 in a modification of the second embodiment. In general, base-band signals, with which a carrier signal is modulated, have unique values of edge-to-edge intervals depending upon the modulation technique employed for producing the modulated signals. The discriminator 22Aa measures the edge-to-edge intervals of the base-band signal, and determines the modulation technique. The discriminator 22Aa supplies a control signal representative of the modulation technique to the envelope detector 22A, and the information processor reads out a constant HYST corresponding to the modulation technique. Thus, a hysteresis loop is determined on the basis of the constant HYST appropriate to the employed modulation technique. The discrimination technique is disclosed in Japan Patent Application No. 2000-363725.

As will be appreciated from the foregoing description, the user can simultaneously vary the loudness of electric tones and the loudness of acoustic piano tones/electronic tones by means of the single volume control dial 13 as similar to the second embodiment, and the input-to-output characteristics of the envelope detector 22A have the hysteresis so that the envelope detector 22A exactly determines the value v' of the volume control signal in spite of the poor stability of the envelope of the regulated quasi audio signal (v·m(t)). Moreover, the volume controller 2A of the modification has the discriminator 22Aa for determining the modulation technique employed in the modulator so that the envelope detector 22A gives appropriate hysteresis to the input-to-output characteristics.

Third Embodiment

Figure 9:
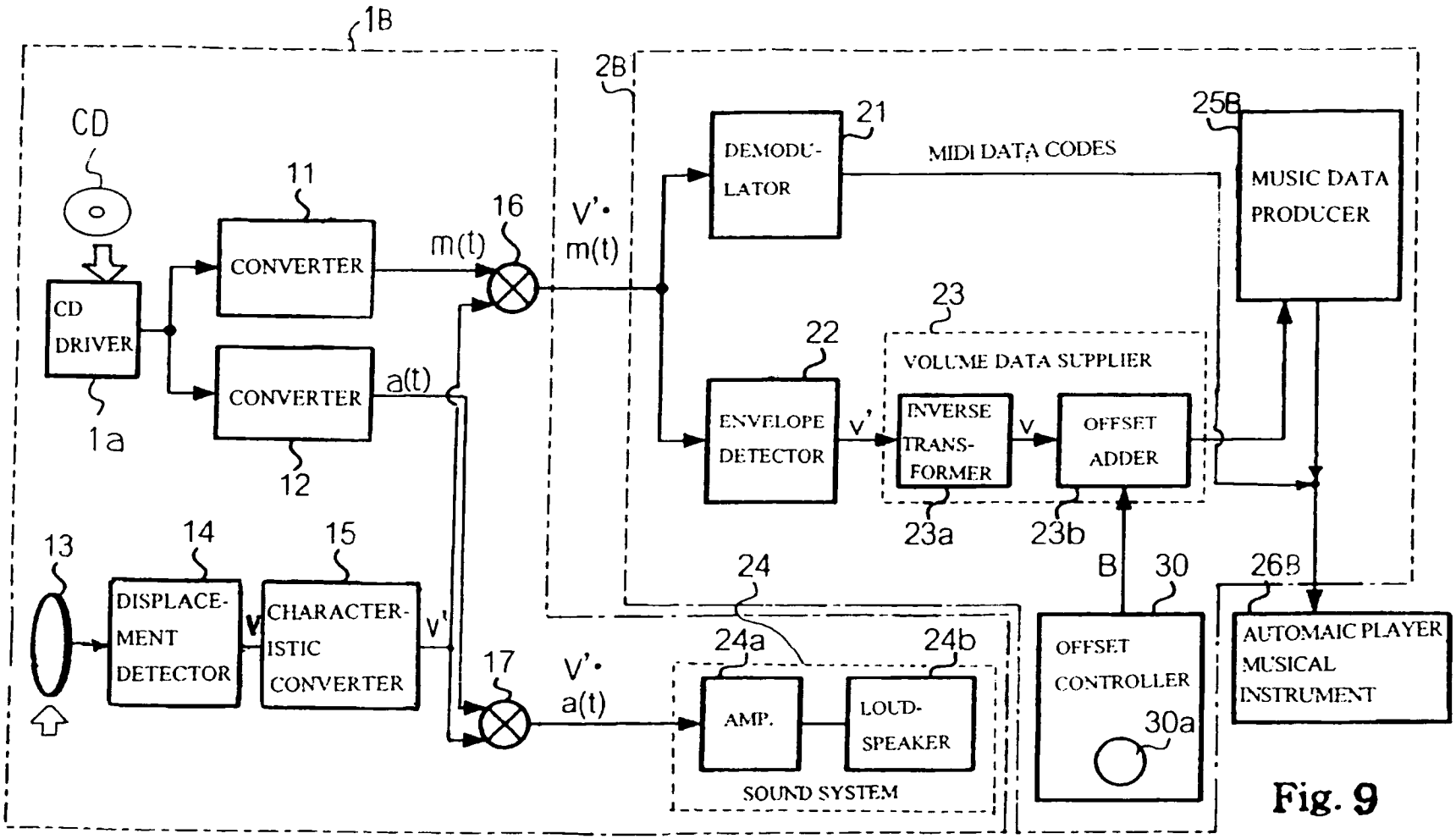
FIG. 9 is a block diagram showing the system configuration of an audio playback apparatus and the system configuration of a volume controller both incorporated in yet another ensemble system of the present invention.

Turning to FIG. 9 of the drawings, yet another ensemble system embodying the present invention largely comprises an audio playback apparatus 1B, a volume controller 2B and an automatic player musical instrument 26B. The audio playback apparatus 1B and automatic player musical instrument 26B are similar to the audio playback apparatus 1 and automatic player musical instrument 26, respectively, and, for this reason, the system components of audio playback apparatus 1B are labeled with references same as those designating the system components of audio playback apparatus 1 without detailed description for the sake of simplicity.

The volume controller 2B is similar in circuit configuration to the volume controller 2 except for a music data producer 25B. The other circuit components are labeled with references designating corresponding circuit components of the volume controller 2, and description is focused on the music data producer 25B.

The volume data changer 25/25A is replaced with the music data producer 25B, and the demodulator 21 is connected to the automatic player musical instrument 26B so as to supply the restored music data codes to the automatic player musical instrument 26B. The music data producer 25B produces a music data code expressing the control change message, and supplies the music data code to the automatic player musical instrument 26B. In this instance, the music data code expresses the channel voice message, which is corresponding to the main volume message in the previous MIDI protocols, on the basis of the volume regulation signal. The format for the channel volume message is expressed as (Bn 07 dM), and (dM) is indicative of the loudness of tones. The music data producer 25B behaves as follows.

While the volume regulation signal, which is output from the volume data supplier 23, is keeping the sum (v+B) constant, the volume data changer stands idle. However, when the user rotates the volume control dial 13 over a certain degree for changing the loudness of electric tones and loudness of acoustic piano tones/electronic tones, the sum (v+B) is varied from the previous value to a new value, the offset adder 23*b* informs the music data producer 25B of the sum of new value and offset value. Then, the music data producer 25B prepares the music data code expressing the channel volume, and (dM) is changed to a value corresponding to the sum of new value and offset value. The music data code expressing the channel volume message is supplied from the music data producer 25B to the automatic player musical instrument 26A. The automatic player musical instrument 26B is responsive to the music data code expressing the channel volume message so as to produce the acoustic piano tones or electronic tones at the given value of loudness.

As will be understood from the foregoing description, the user can simultaneously vary the loudness of electric tones and the loudness of acoustic piano tones/electronic tones by means of the single volume control dial 13 as similar to the first embodiment.

Both of the music data producer 25B and volume data changer 25 are incorporated in a volume controller of a modification of the third embodiment. In case where the channel volume message has been mixed into the quasi audio data codes, the volume data changer 25 changes (dM) to the sum of new value and offset value.

Fourth Embodiment

Figure 10:
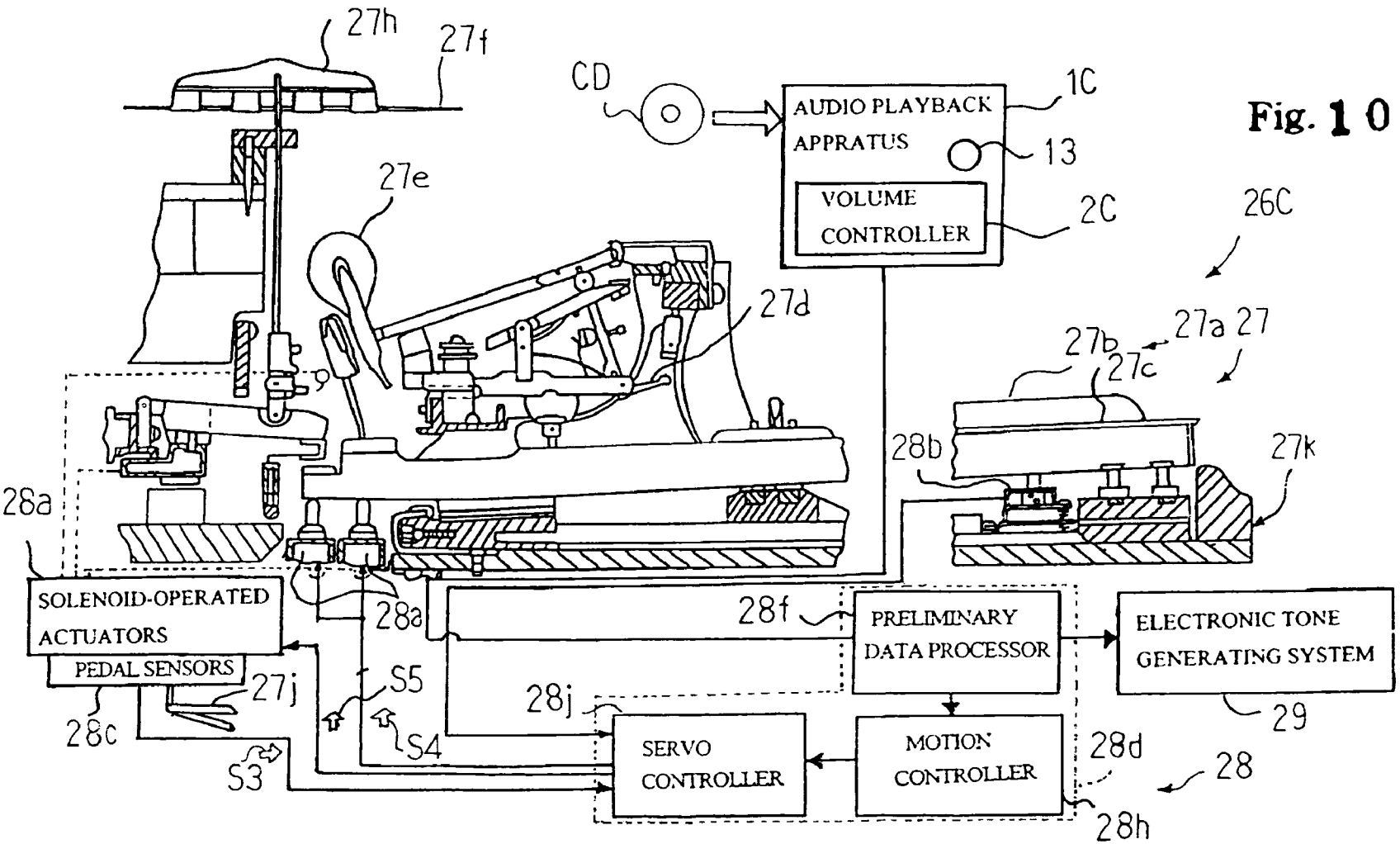
FIG. 10 is a schematic side view showing the structure of an automatic player piano and an audio playback apparatus with a built-in volume controller of the present invention.

FIG. 10 shows still another ensemble system embodying the present invention. The ensemble system largely comprises an audio playback apparatus 1C with a built-in volume controller 2C and an automatic player musical instrument 26C. The built-in volume controller 2C are housed in a cabinet together with other system components, which are corresponding to the system components 1*a*, 11, 12, 14, 15, 16, 17 and 24, and the volume control dial 13 is provided on the front panel of the cabinet. The built-in volume controller 2C and automatic player musical instrument 26C are similar in system arrangement to the volume controller 2 and automatic player musical instrument 26, respectively.

A user instructs the audio playback apparatus 1C to vary the loudness of electric tones and the loudness of acoustic piano tones/electronic tones through the single volume control dial 13. The audio playback apparatus 1C behaves as similar to the audio playback apparatus 1 and volume controller 2, and the behavior of automatic player musical instrument 26C is same as that of the automatic player musical instrument 26. For this reason, no further description is incorporated for the sake of simplicity.

Fifth Embodiment

Figure 11:
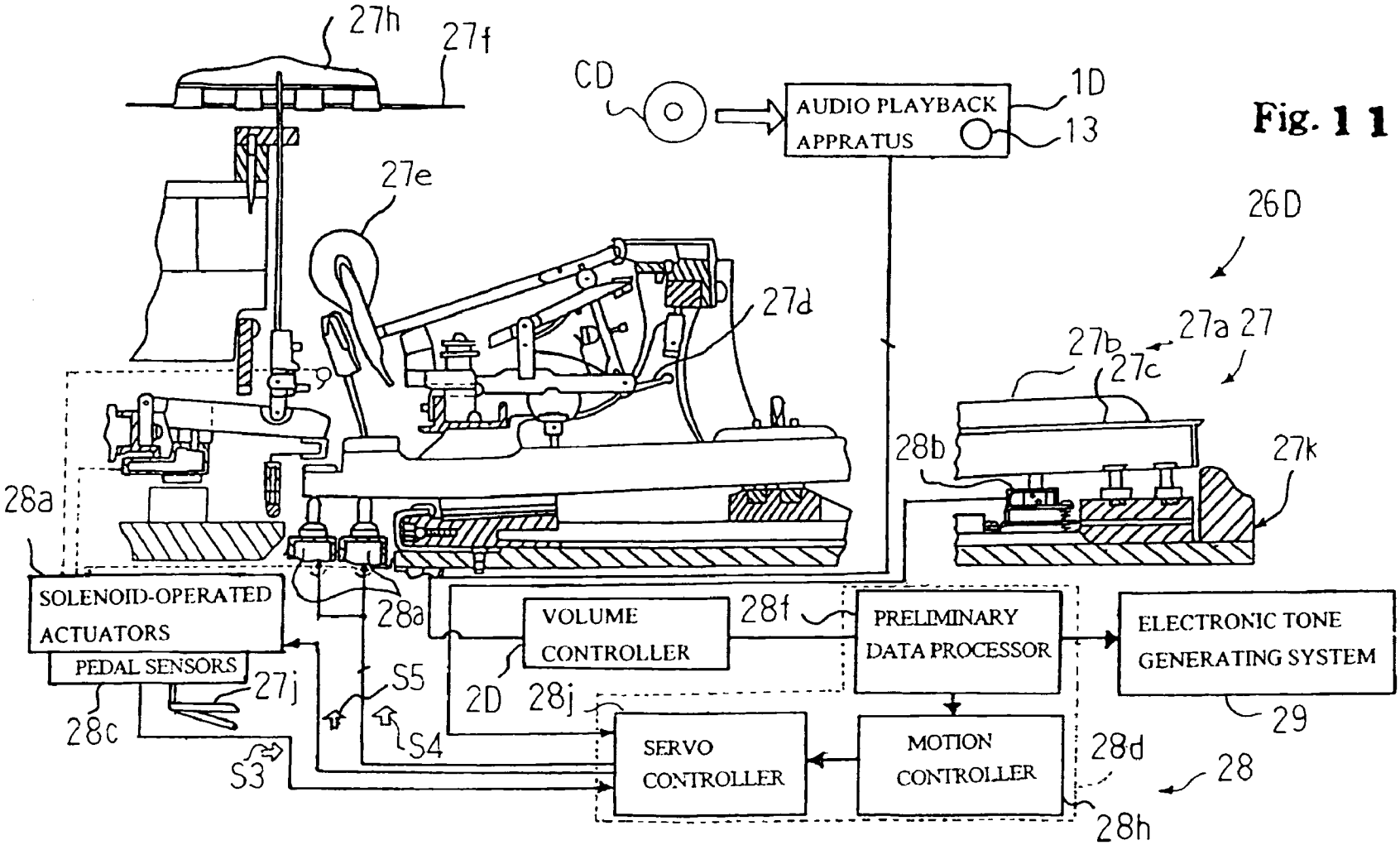
FIG. 11 is a schematic side view showing the structure of an automatic player piano with a built-in volume controller and an audio playback apparatus of the present invention.

Turning to FIG. 11 of the drawings, yet another ensemble system embodying the present invention largely comprises an audio playback apparatus 1D and an automatic player musical instrument 26D with a built-in voltage controller 2D. The audio playback apparatus 1D, automatic player musical instrument 26D and built-in volume controller 2D are similar to the audio playback apparatus 1, automatic player musical instrument 26 and voltage controller 2 so that the system components of audio playback apparatus 1D, component parts of automatic player musical instrument 26D and system components of built-in voltage controller 2D are labeled with references designating corresponding system components of audio playback apparatus 1, corresponding component parts of automatic player musical instrument 26 and corresponding system components of voltage controller 2 without detailed description for the sake of simplicity.

The built-in volume controller 2D is housed in a cabinet together with the other system components of the electronic system 28*d*, and the regulated quasi audio signal ($v \cdot m(t)$) is supplied from the audio playback apparatus 1D to the built-in volume controller 2D.

A user instructs the audio playback apparatus 1D to vary the loudness of electric tones and the loudness of acoustic piano tones/electronic tones through the single volume control dial 13 on the cabinet of the audio playback apparatus 1D. The audio playback apparatus 1D, built-in volume controller 2D and automatic player musical instrument 26D behave as similar to the audio playback apparatus 1, volume controller 2 and automatic player musical instrument 26C. For this reason, no further description is incorporated for the sake of simplicity.

A modification of the fifth embodiment includes a built-in volume controller, and the multiplier 16 is incorporated in the built-in volume controller together with the system components 21, 22, 23, 25 and 30. In this instance, the analog quasi audio signal m(t) and volume control signal v' are supplied from the audio playback apparatus 1D to the built-in volume controller.

Sixth Embodiment

Figure 12:
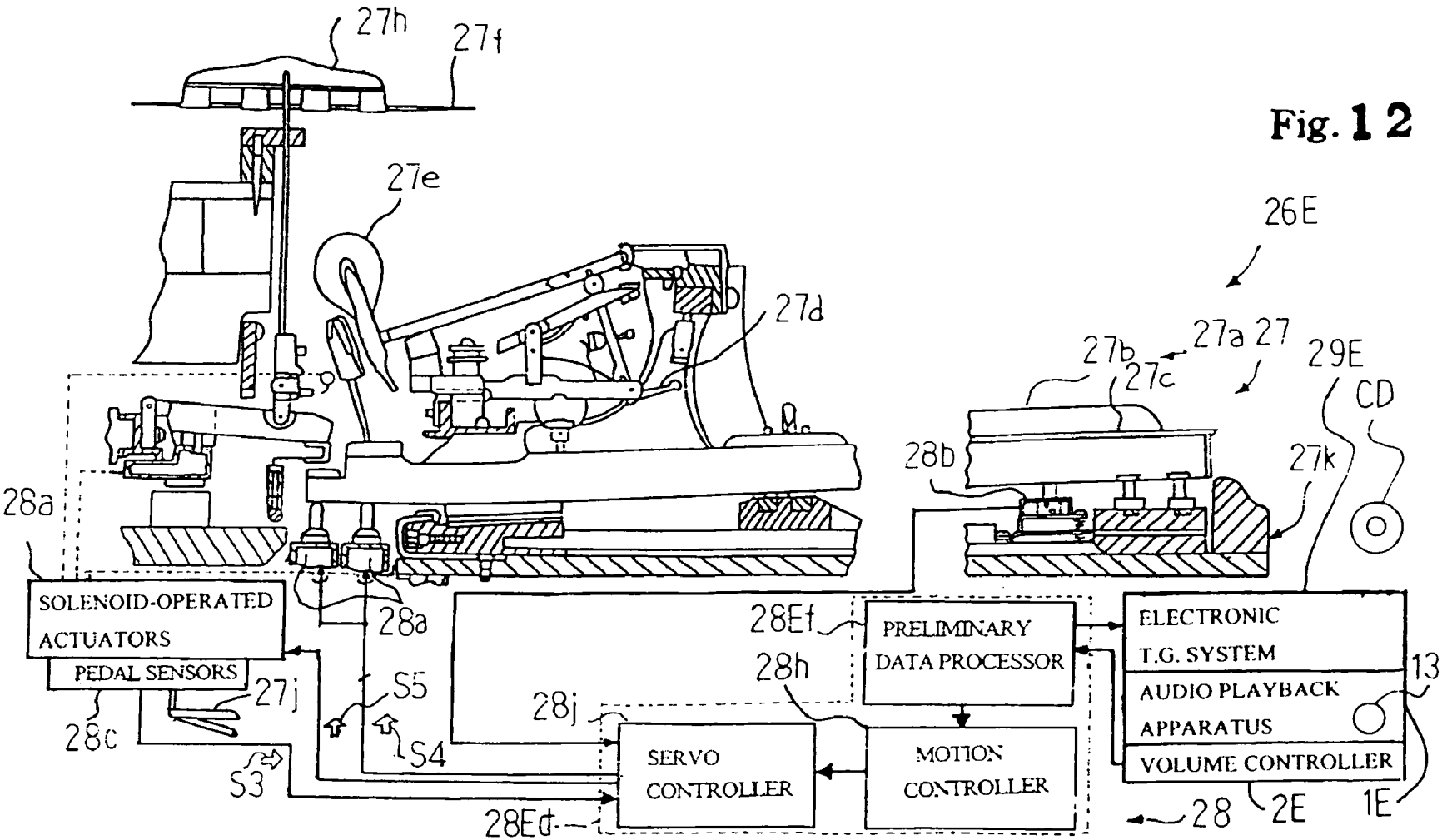
FIG. 12 is a schematic side view showing the structure of an automatic player piano with a built-in audio playback apparatus and a built-in volume controller of the present invention.

Turning to FIG. 12 of the drawings, still another ensemble system embodying the present invention largely comprises an automatic player musical instrument 26E with a built-in audio playback apparatus 1E and a built-in voltage controller 2E. The built-in audio playback apparatus 1E and built-in volume controller 2E are similar to the audio playback apparatus 1 and voltage controller 2 so that the system components of built-in audio playback apparatus 1E and system components of built-in voltage controller 2E are labeled with references designating corresponding system components of audio playback apparatus 1 and corresponding system components of voltage controller 2 without detailed description for the sake of simplicity.

The automatic player musical instrument 26E is different from the automatic player musical instrument 26 in that the sound system 24 is shared between the built-in audio playback apparatus 1E and the electronic tone generating system 29E. The amplifiers 26*e* and loudspeakers 26*f* are deleted from the electronic tone generating system 29E so that the tone generator 26*b* and digital-to-analog converter 26*d* form parts of the electronic tone generating system 26E. In case where the user chooses the electronic tones, the analog audio signal is supplied from the digital-to-analog converter 26*d* to a mixer, which is incorporated in the sound system, to the amplifiers 24*a*.

The built-in audio playback apparatus 1E and built-in volume controller 2E are housed in a cabinet together with the other system components of the electronic system 28*d*, and the compact disc CD is put on the tray of the compact disc driver 1*a* of the audio playback apparatus 1E.

A user instructs the audio playback apparatus 1E to vary the loudness of electric tones and the loudness of acoustic piano tones/electronic tones through the single volume control dial 13 on the cabinet. The audio playback apparatus 1E, built-in volume controller 2E and automatic player musical instrument 26E behave as similar to the audio playback apparatus 1, volume controller 2 and automatic player musical instrument 26C. For this reason, no further description is incorporated for the sake of simplicity.

Although particular embodiments of the present invention have been shown and described, it will be apparent to those skilled in the art that various changes and modifications may be made without departing from the spirit and scope of the present invention.

For example, the volume data supplier 23 may change the volume regulation signal only when the value v exceeds a threshold. If the user instructs the ensemble system to reduce the loudness of electric tones and loudness of acoustic piano tones/electronic tones to a value below the threshold, the audio playback apparatus 1 and volume controller 2 stop the electric tones and acoustic piano tones/electronic tones, or put themselves in muting state. This is because of the fact that the regulated quasi audio signal ($v' \cdot m(t)$) with an extremely narrow amplitude is hardly demodulated to the music data codes. The volume data supplier 23 may compare the value v with the threshold so as to see whether or not the ensemble system stops the playback.

Although the above-described embodiments determine the value v' on the basis of the envelope of the regulated quasi audio signal ($v' \cdot m(t)$), an effective value may be calculated for the regulated quasi audio signal ($v' \cdot m(t)$). RMS (root mean square) value may serve as the effective value. In case where a difference is forecasted between the envelope and the RMS value, the RMS value may be corrected through an appropriate proportional expression.

The offset controller 30 and offset adder 23*b* may be deleted from the volume controller 2, if the irregularity is ignorable. On the other hand, the offset value B may be automatically determined through comparison between the regulated audio signal (v'·a(t)) and reference values. The volume data supplier 23 may compare the regulated audio signal (v'·a(t)) with the reference values at regular time intervals or arbitrary time intervals. The offset value B may be given to the offset adder 23*b* concurrently with the value v. Otherwise, the offset values are successively accumulated in a random access memory to see whether or not the rate of change exceeds a threshold. When the rate of change exceeds the threshold, the offset value B is supplied to the offset adder 23*b*.

The audio data codes and quasi audio data codes may be stored in another sort of information storage medium such as, for example, a DVD (Digital Versatile Disc), a DAT (Digital Audio Tape) and a magnetic tape cassette. Otherwise, the audio data codes and quasi audio data codes may be supplied from a server computer through a communication network, and are propagated through a cable or a radio channel.

The quasi audio data codes may be stored in an information storage medium physically separated from an information storage medium where the audio data codes are stored. In this instance, the quasi audio data codes are read out from the information storage medium synchronously with the readout of the audio data codes. Various synchronizers have been already proposed so that an appropriate synchronizer is employed in the ensemble system.

Although the automatic player musical instrument 26 has the amplifiers 26*e* and loudspeakers 26*f*, the amplifiers 26*e* and loudspeakers 26*f* may be deleted from the electronic tone generating system 29, and the digital-to-analog converter 26*d* is connected to the amplifiers 24*a* through a mixer. In this instance, both of the audio signal and regulated audio signal (v'·a(t)) are mixed through the mixer, and, thereafter, the mixed audio signal is supplied to the amplifiers 24*a*.

The characteristic converter 15 and inverse transformer 23*a* are not indispensable feature of the present invention. In other words, the characteristic converter 15 and inverse transformer 23*a* may be deleted from the audio playback apparatus 1 and volume controller 2, respectively. Of course, another sort of transformer and inverse transformer may be employed.

The modulation technique and demodulation technique disclosed in Japanese Patent Application laid-open No. 2001-308942 do not set any limit to the technical scope of the present invention. Another sort of modulation technique and corresponding demodulation technique such as, for example, a binary FSK modulation may be employed in an ensemble system of the present invention.

The automatic player piano 26 does not set any limit to the technical scope of the present invention. An electronic keyboard may be combined with the audio playback apparatus 1 and volume controller 2. Any sort of musical instrument is available for the ensemble system of the present invention in so far as the musical instrument is responsive to the music data codes, the formats of which are defined in MIDI protocols or another sort of music data protocols.

The volume control dial 13 may be replaced with another sort of data input device such as, for example, a lever, a slider or an array of buttons.

An automatic player musical instrument may not have the electronic tone generating system 29 so that only the acoustic tones are produced on the basis of the music data codes.

The system components and component parts of the above-described embodiments are correlated with claim languages as follows.

The ensemble systems implementing the first to fifth embodiments are corresponding to an "ensemble system", and the automatic playing musical instrument 26E with built-in audio playback apparatus 1E and built-in volume controller 2E serves as the "ensemble" system.

The compact disc driver 1*a* and converters 11 and 12 form parts of a "sound signal generator". The electric tones are corresponding to a "first sort of tones", and the analog audio signal a(t) is representative of "pieces of audio data". The acoustic piano tones and electronic tones are corresponding to a "second sort of tones", and the analog quasi audio signal m(t) is representative of "pieces of music data".

The volume control dial 13 serves as a "volume control manipulator". The displacement detector 14 and characteristic converter 15 form parts of a "volume control signal generator", and the volume control signal v' is corresponding to a "volume control signal".

The multiplier 17 serves as a "first volume data changer", and the multiplier 16, demodulator 21, envelope detector 22 and volume data supplier 23 as a whole constitute a "second volume data changer".

The sound system 24, electronic tone generating system 29, acoustic piano 26/26A/26B/26C/26D and automatic playing system 28 as a whole constitute a "signal-to-sound converter", and the electronic tone generating system 29E, acoustic piano 26E and automatic playing system 28 also form in combination the "signal-to-sound converter".

The compact disc CD serves as an "information storage medium".

The sound system 24 and/or amplifiers 26*e* and loudspeakers 26*f* serve as a "signal-to-sound converting unit", and the acoustic piano 26/26A/26B/26C/26D/26E, automatic playing system 28 and electronic tone generating system 29/29E form parts of a "tone generating unit".

The demodulator 21 and multiplier 16 serve as a "code restorer", and said multiplier 16, envelope detector 22 and volume data supplier 23 form in combination an "estimator". The volume data changer 25 serves as a "music data modifier".

What is claimed is:

1. An ensemble system for reproducing a first sort of tones and a second sort of tones from pieces of audio data and pieces of music data expressing at least pitch and loudness of tones to be produced, respectively, comprising:

a sound signal generator producing an audio signal from audio data codes representative of said pieces of audio data and a music signal from quasi audio data codes representative of said pieces of music data and common in formats to said audio data codes, said quasi audio data codes being produced from music data codes expressing said at least pitch and loudness through a modulation to an analog music signal and a conversion from said analog music signal;

a volume control manipulator manipulated by a user so as simultaneously to vary the loudness of said first sort of tones and the loudness of said second sort of tones;

a volume control signal generator connected to said volume control manipulator, and producing a volume control signal representative of a target value of loudness of both of said first sort of tones and said second fort of tones on the basis of the manipulation of said user;

a first volume data changer connected to said sound signal generator and said volume control signal generator, and responsive to said volume control signal so as to vary said pieces of audio data expressing the loudness of said first sort of tones;

a second volume data changer connected to said sound signal generator and said volume control signal generator, and responsive to said volume control signal so as to vary said pieces of music data expressing said loudness of said second fort of tones; and a signal-to-sound converter connected to said first volume data changer and said second volume data changer, converting the audio signal output from said first volume data changer to said first sort of tones at said target value of loudness, and producing said second sort of tones on the basis of said music signal output from said second volume data changer at said target value of loudness.

2. The ensemble system as set forth in claim 1, in which said audio data codes are produced from an analog audio signal so as to express discrete values on a waveform of said analog audio signals.

3. The ensemble system as set forth in claim 2, in which said music data codes have formats defined in MIDI (Musical Instrument Digital Interface) protocols.

4. The ensemble system as set forth in claim 1, in which said signal-to-sound converter includes a signal-to-sound converting unit for converting said audio signal to said first sort of tones at said target value of loudness, and a tone generating unit for producing said second sort of tones on the basis of said music signal at said target value of loudness.

5. The ensemble system as set forth in claim 4, in which said tone generating unit includes an acoustic musical instrument and an automatic playing system for performing pieces of music on said acoustic musical instrument without any fingering of a human player.

6. The ensemble system as set forth in claim 5, in which said acoustic musical instrument and said automatic playing system form an automatic player musical instrument together with said signal-to-sound converter.

7. The ensemble system as set forth in claim 5, in which said acoustic musical instrument and said automatic playing system form an automatic player musical instrument together with said second volume data changer.

8. The ensemble system as set forth in claim 5, in which said acoustic musical instrument and said automatic playing system form an automatic player musical instrument together with said sound signal generator, said volume control manipulator, said volume control signal generator, said first volume data changer, said second volume data changer and said signal-to-sound converter.

9. An audio playback apparatus for producing a volume-regulated audio signal and volume regulated music data codes, comprising:

a sound signal generator producing an audio signal from audio data codes representative of pieces of audio data expressing a first sort of tones and a music signal from quasi audio data codes representative of pieces of music data expressing at least pitch and loudness of a second sort of tones and common in formats to said audio data code, said quasi audio data codes being produced from music data codes expressing said at least pitch and loudness through a modulation to an analog music signal and a conversion from said analog music signal;

a volume control manipulator manipulated by a user so as simultaneously to vary the loudness of said first sort of tones and the loudness of said second sort of tones;

a volume control signal generator connected to said volume control manipulator, and producing a volume control signal representative of a target value of loudness of both of said first sort of tones and said second fort of tones on the basis of the manipulation of said user;

a first volume data changer connected to said sound signal generator and said volume control signal generator, and responsive to said volume control signal so as to vary said pieces of audio data expressing the loudness of said first sort of tones, thereby producing said voltage-regulated audio signal; and a second volume data changer connected to said sound signal generator and said volume control signal generator, and responsive to said volume control signal so as to vary said pieces of music data expressing said loudness of said second fort of tones, thereby producing said voltage-regulated music data codes.

10. The audio playback apparatus as set forth in claim 9, in which said audio data codes are produced from an analog audio signal so as to express discrete values on a waveform of said analog audio signals.

11. The audio playback apparatus as set forth in claim 10, in which said music data codes have formats defined in MIDI (Musical Instrument Digital Interface) protocols.

12. The audio playback apparatus as set forth in claim 9, in which said audio data codes are stored in data blocks of an information storage medium for one of the right and left channels, and said quasi audio data codes are stored in other data blocks of said information storage medium for the other of said right and left channels.

13. The audio playback apparatus as set forth in claim 9, in which said volume control signal generator includes a displacement detector connected to said volume control manipulator and determining displacement of said volume control manipulator during the manipulation by said user, and a characteristic converter connected to said displacement detector and converting said displacement to an amount of loudness to be varied so as to cancel tendency of ears of said user between said displacement and said amount of loudness.

14. The audio playback apparatus as set forth in claim 9, further comprising a signal-to-sound converting unit connected to said first voltage data changer for converting said volume-regulated audio signal to said first sort of tones at said target value of loudness.

15. An audio playback apparatus for producing a volume-regulated audio signal and volume regulated music data codes, comprising:

a sound signal generator producing an audio signal representative of pieces of audio data expressing a first sort of tones and a music signal representative of pieces of music data expressing at least pitch and loudness of a second sort of tones;

a volume control manipulator manipulated by a user so as simultaneously to vary the loudness of said first sort of tones and the loudness of said second sort of tones;

a volume control signal generator connected to said volume control manipulator, and producing a volume control signal representative of a target value of loudness of both of said first sort of tones and said second sort of tones on the basis of the manipulation of said user;

a first volume data changer connected to said sound signal generator and said volume control signal generator, and responsive to said volume control signal so as to vary said Pieces of audio data expressing the loudness of said first sort of tones, thereby producing said voltage-regulated audio signal; and a second volume data changer connected to said sound signal generator and said volume control signal generator, and responsive to said volume control signal so as to vary said pieces of music data expressing said loudness of said second sort of tones, thereby producing said voltage-regulated music data codes, in which said second volume data changer includes an estimator connected to said volume control signal generator for determining a target value of loudness of said second sort of tones on the basis of said volume control signal, a code restorer connected to said sound signal generator so as to reproduce music data codes expressing at least said Ditch and said loudness from said music signal output from said sound signal generator, and a music data modifier connected to said estimator and said code restorer and modifying bit strings of said music data codes expressing said loudness to other bit strings expressing said target value of loudness so as to produce said voltage-regulated music data codes, and in which said estimator includes a multiplier connected to said sound signal generator and said voltage control signal generator and multiplying said music signal by said voltage control signal so as to produced amplified music signal, and an envelope detector connected to said multiplier so as to calculate a ratio of the magnitude of said amplified music signal to said music signal on the basis of an envelope of said amplified music signal, thereby determining said target loudness of said second sort of tones on the basis of said ratio.

16. A volume controller for modifying music data codes expressing at least pitch and loudness of tones to be produced, comprising:

an estimator supplied with a volume control signal simultaneously expressing said loudness of said tones and loudness of other tones to be produced from audio data codes, and determining a target value of said loudness of said tones on the basis of said volume control signal;

a code restorer supplied with a music signal, and restoring said music signal to said music data codes; and a music data modifier connected to said estimator and said code restorer and modifying bit strings of said music data codes expressing said loudness to other bit strings expressing said target value of loudness so as to produce voltage-regulated music data codes, said music data codes being produced from quasi audio data codes through a conversion from said audio data codes to an analog music signal, a demodulation on said analog music signal and a restoration from the demodulated signal thereto.

17. The volume controller as set forth in claim 16, in which said music data codes have a format for a note-on key event defined in MIDI (Musical Instrument Digital Interface) protocols.

18. The volume controller as set forth in claim 17, further comprising a music data code propagation path connected to said code restorer so as to permit other music data codes to bypass said music data modifier.

19. The volume controller as set forth in claim 16, in which said target value of loudness is calculated from an input value of loudness input by a user in such a manner as to cancel tendency of ears of said user between a displacement of a volume manipulator and said loudness of tones, and said estimator has an inverse transformer restoring said target value to said input value so that said music data modifier modifies said bit strings to said other bit strings expressing said input value.

20. A volume controller for modifying music data codes expressing at least pitch and loudness of tones to be produced, comprising:

an estimator supplied with a volume control signal simultaneously expressing said loudness of said tones and loudness of other tones to be produced from audio data codes, and determining a target value of said loudness of said tones on the basis of said volume control signal;

a code restorer supplied with a music signal, and restoring said music signal to said music data codes; and a music data modifier connected to said estimator and said code restorer and modifying bit strings of said music data codes expressing said loudness to other bit strings expressing said target value of loudness so as to produce voltage-regulated music data codes, in which said estimator includes a multiplier connected to said music signal generator and said voltage control signal generator and multiplying said music signal by said voltage control signal so as to produced amplified music signal, and an envelope detector connected to said multiplier so as to calculate a ratio of the magnitude of said amplified music signal to said music signal on the basis of an envelope of said amplified music signal, thereby determining said target loudness on the basis of said ratio.

21. The volume controller as set forth in claim 20, in which said estimator further includes an offset adder supplied with an offset signal representative of an offset value of said loudness and adding said offset value to said target value so that said music data modifier modifies said bit strings to said other bit strings expressing the sum of said target value and said offset value.

22. The volume controller as set forth in claim 20, in which said envelope detector gives a hysteresis to the relation between values on said envelope and said target loudness.

* * * * *